US006529180B1

(12) United States Patent
Ito et al.

(10) Patent No.: US 6,529,180 B1
(45) Date of Patent: Mar. 4, 2003

(54) LIQUID CRYSTAL DISPLAY DEVICE HAVING HIGH SPEED DRIVER

(75) Inventors: Shigeru Ito, Mobara (JP); Noboru Kataoka, Oami-shirasato (JP); Akira Ogura, Nagara (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 264 days.

(21) Appl. No.: 09/611,533

(22) Filed: Jul. 6, 2000

(30) Foreign Application Priority Data

Jul. 9, 1999 (JP) ..... 11-196212

(51) Int. Cl.[7] ..... G09G 3/36

(52) U.S. Cl. ..... 345/89; 345/87; 345/98; 345/99; 345/100; 345/690; 345/208; 345/209; 345/210

(58) Field of Search ..... 345/87, 89, 90, 345/92, 94, 95, 96, 98, 99, 100, 690, 208, 209, 210

(56) References Cited

U.S. PATENT DOCUMENTS 5,414,443 A * 5/1995 Kanatani et al. ..... 345/95
5,453,757 A * 9/1995 Date et al. ..... 345/89
5,510,807 A * 4/1996 Lee et al. ..... 345/103
5,617,111 A * 4/1997 Saitoh ..... 345/100
5,982,349 A * 11/1999 Yoon ..... 345/98
6,313,819 B1 * 11/2001 Maekawa et al. ..... 345/92

* cited by examiner

*Primary Examiner*—Bipin Shalwala
*Assistant Examiner*—Jimmy H. Nguyen
(74) *Attorney, Agent, or Firm*—Antonelli, Terry, Stout & Kraus, LLP

(57) ABSTRACT

A liquid crystal display device constituted by a liquid crystal display element and at least a single piece of semiconductor integrated circuit device and having image signal line driving means for supplying grayscale voltages in correspondence with display data to respective image signal lines of the liquid crystal display element the semiconductor integrated circuit device includes a plurality of grayscales voltage selecting means for selecting grayscale voltages in correspondence with display data inputted from a plurality of grayscale voltages, a plurality of amplifiers for amplifying the grayscale voltages selected by the respective grayscale voltage selecting means and outputting the grayscale voltages to respective image signal lines and a precharge control circuit provided between the respective grayscale voltage selecting means and the respective amplifiers.

19 Claims, 31 Drawing Sheets

Odd frame

Even frame

Conventional Circuit

Vout = Vin (no offset voltage)
Vout = Vin + Voff (offset voltage)

LIQUID CRYSTAL DISPLAY DEVICE HAVING HIGH SPEED DRIVER

BACKGROUND OF THE INVENTION

The present invention relates to a liquid crystal display device, and, more particularly, to a technology applicable to image signal line driving (drain driver) of a liquid crystal display device which is capable of producing a multiple grayscale display.

An active matrix type liquid crystal display device having an active element (for example, thin film transistor) for each pixel, and in which a display is produced by selectively driving the active elements, is widely used as a notebook type personal computer. In the active matrix type liquid crystal display device, an image signal voltage (grayscale voltage in correspondence with display data; hereinafter, referred to as a grayscale voltage) is applied via the active element; and, accordingly, there is no cross talk among respective pixels, so that it is not necessary to use a special drive method for preventing cross talk as in a simple matrix type liquid crystal display device, whereby multiple grayscale display is feasible.

As one known example of the active matrix type liquid crystal display device, there is a liquid crystal display device having a liquid crystal display panel (TFT-LCD) of the TFT (Thin Film Transistor) type, a drain driver arranged on an upper side of the liquid crystal display panel, a gate driver arranged at a side face of the liquid crystal display panel and an interface unit. According to the TFT type liquid crystal display device, there are provided a grayscale voltage generating circuit, a grayscale voltage selecting circuit (decoder circuit) for selecting one grayscale voltage in correspondence with display data from among a plurality of grayscale voltages generated in the grayscale voltage generating circuit and an amplifier connected to receive the one grayscale voltage selected by the grayscale voltage selecting circuit. Such a technology is described in, for example, Japanese Application No. 8-86668.

SUMMARY OF THE INVENTION

In recent years, in a liquid crystal display device of a liquid crystal module of the TFT type, along with demands for a large screen liquid crystal display panel, there is a further demand for a high resolution formation, such as 1024×768 pixels in the XGA display mode, 1280×1024 pixels in the SXGA display mode or 1600×1200 pixels in the UXGA display mode. Therefore, the number of horizontal scans in one vertical scan period is increased; and, in accordance therewith, the write time period per one horizontal scan become shorter and shorter, and so the output delay time period (tDD) of the drain driver poses a serious problem.

For example, in the XGA display mode, the write time period per one horizontal scan is about 20 $\mu$s, and there is also a case in which the output delay time period (tDD) of the drain driver reaches 10 through 20 $\mu$s. In such a case, the pixel write voltage becomes deficient and the display quality of the image displayed on the liquid crystal display panel is significantly deteriorated.

Meanwhile, in a liquid crystal display device, there is a tendency toward large size formation and high resolution formation (multiple pixel formation). Furthermore, in order to dispense with wasteful space and produce a display device having an attractive appearance, a region other than a display region of the liquid crystal display device, that is, a frame edge portion thereof, should be reduced in size (narrow frame edge formation). For that purpose, it is necessary to further reduce the chip size of a semiconductor chip constituting a drain driver; and, in accordance therewith, the grayscale voltage selecting circuit has been constituted by a field effect type transistor (MOS transistor) of a minimum size. As a result, the current driving function of the grayscale voltage selecting circuit is lowered, and the time period (output delay time period) for determining the grayscale voltage in correspondence with display data by the grayscale voltage selecting circuit is increased, which constitutes a significant factor in the output delay time period (tDD) of the drain driver.

Further, in a liquid crystal display device, the multiple grayscale display is being advanced from a 64 value grayscale display to a 256 value grayscale display, and the voltage width per grayscale value of a plurality of grayscale voltages generated by the grayscale voltage generating circuit (that is, potential difference between contiguous grayscale voltages) is reduced. Meanwhile, with respect to an amplifier for amplifying the grayscale voltage, owing to a dispersion in the characteristic of the active element constituting the amplifier, an offset voltage is produced; and, when the offset voltage is produced in the amplifier, an error is caused in the output voltage of the amplifier, and the output voltage of the amplifier becomes a voltage different from a target value (regular grayscale voltage). This results in a problem in which a vertical streak of black or white is produced on the display screen displayed on the liquid crystal display panel, which significantly deteriorates the display quality.

The invention has been carried out in order to resolve the above-described problems of the conventional technology, and it is an object of the invention to provide a technology capable of promoting the display quality of a display image displayed on a liquid crystal display element in a liquid crystal display device.

It is another object of the invention to provide a technology enabling high speed operation and large screen formation of a liquid crystal display element in a liquid crystal display device.

The objects and novel characteristics of the invention will become more apparent from the following description and the attached drawings.

A simple explanation will be given of representatives features of the invention disclosed in the specification.

That is, according to an aspect of the invention, there is provided a liquid crystal display device comprising a liquid crystal display element having a plurality of pixels provided in a matrix arrangement and a plurality of image signal lines for applying grayscale voltages in correspondence with display data to respective pixels in a column (or row) direction to the plurality of pixels, and image signal line driving means constituted by at least a single semiconductor integrated circuit device for supplying the grayscale voltages in correspondence with the display data to the respective image signal lines. The semiconductor integrated circuit device comprises a plurality of grayscale voltage selecting means for selecting the grayscale voltages in correspondence with the display data inputted from the plurality of grayscale voltages and constituted by a transistor having a minimum size in the semiconductor integrated circuit device; a plurality of amplifiers for amplifying the grayscale voltages selected by the respective grayscale voltage selecting means and for outputting the selected grayscale voltages to the respective image signal lines; first switching means provided between the respective grayscale voltage selecting means and the amplifiers; second switching means provided between a power source line supplied with a predetermined charge voltage and the respective amplifiers; and switching controlling means for switching off the first switching means and switching on the second switching means in an initial predetermined time period of one horizontal scanning time period.

Further, according to another aspect of the invention, there is provided a liquid crystal display device comprising a liquid crystal display element having a plurality of pixels provided in a matrix arrangement and a plurality of image signal lines for applying grayscale voltages in correspondence with display data to respective pixels in a column (or row) direction to the plurality of pixels, and image signal line driving means constituted by at least a single piece of a semiconductor integrated circuit device for supplying the grayscale voltages in correspondence with the display data to the respective image signal lines. The semiconductor integrated circuit device comprises a plurality of grayscale voltage selecting means for selecting the grayscale voltages in correspondence with the display data inputted from the plurality of grayscale voltages and constituted by a transistor having a minimum size in the semiconductor integrated circuit device; a plurality of amplifiers for amplifying the grayscale voltages selected by the respective grayscale voltage selecting means and outputting the selected grayscale voltages to the respective image signal lines, the plurality of amplifiers including switching means for switching one of a pair of two terminals of each of the amplifiers to an inverted input terminal or a noninverted input terminal and switching other of the pair of two terminals to the noninverted input terminal or the inverted input terminal; first switching means provided between the respective grayscale voltage selecting means and the respective amplifiers; second switching means provided between a power source line supplied with predetermined charge voltage and the respective amplifiers; switching controlling means for switching off the first switching means and switching on the second switching means in an initial predetermined time period in one horizontal scanning time period; and switching instructing means for outputting a switch control signal for switching one of the pair of input terminals of each of the amplifiers to the noninverted input terminal and switching other input terminal thereof to the inverted input terminal to the switching means of the amplifiers at every predetermined period.

Further, according to another aspect of the invention, there is provided a liquid crystal display apparatus, wherein the switching controlling means switches off the first switching means before for switching on the second switching means and switching on the first switching means after switching off the second switching means.

Further, according to another aspect of the invention, there is provided a liquid crystal display device, wherein the switching controlling means controls the first and the second switching means based on a clock for controlling an output timing and a clock for latching the display data.

Further, according to another aspect of the invention, there is provided a liquid crystal display device, wherein the predetermined charge voltage is any voltage in the plurality of grayscale voltages.

Further, according to another aspect of the invention, there is provided a liquid crystal display device, wherein the semiconductor integrated circuit device includes grayscale voltage generating means for generating the plurality of grayscale voltages based on a plurality of grayscale reference voltages supplied from outside and supplying the plurality of grayscale voltages to the respective grayscale voltage selecting means, and wherein the predetermined precharge voltage is any voltage in the plurality of grayscale reference voltages supplied from outside.

Further, according to another aspect of the invention, there is provided a liquid crystal display device, wherein, when in the plurality of grayscale voltages supplied to one side of a liquid crystal layer of each of the plurality of pixels, the grayscale voltage having the largest potential difference relative to an opposed voltage applied to the other side of the liquid crystal layer of each of the plurality of pixels constitutes a maximum grayscale voltage and the grayscale voltage having the smallest potential difference relative to the opposed voltage constitutes the smallest grayscale voltage, the predetermined charge voltage is a voltage deviated to the maximum grayscale voltage in comparison with an intermediate voltage between the maximum grayscale voltage and the minimum grayscale voltage.

Further, according to another aspect of the invention, there is provided a liquid crystal display device, wherein the plurality of amplifiers comprise a plurality of couples of amplifier couples constituted by first amplifiers couples of which output grayscale voltages having a positive polarity and second amplifiers couples of which output grayscale voltages having a negative polarity, wherein the grayscale voltage selecting means connected to the first amplifiers of the respective amplifier couples select grayscale voltages in correspondence with display data inputted from the plurality of grayscale voltages having a positive polarity, wherein the grayscale voltage selecting means connected to the second amplifiers of the respective amplifier couples select grayscale voltages in correspondence with the display data inputted from the plurality of grayscale voltages having a negative polarity, further comprising display data switching means for switching alternately arbitrary couples of display data inputted to the grayscale voltage selecting means connected to the first amplifiers of the respective amplifier couples and the grayscale voltage selecting means connected to the second amplifiers of the respective amplifier couples, and image signal line switching means for switching alternately the couples of grayscale voltages outputted from the respective amplifier couples in accordance with switching of the display data switching means and outputting the couples of grayscale voltages to arbitrary couples of the image signal lines.

DESCRIPTION OF THE PREFERRED EMBODIMENTS

Figure 1:
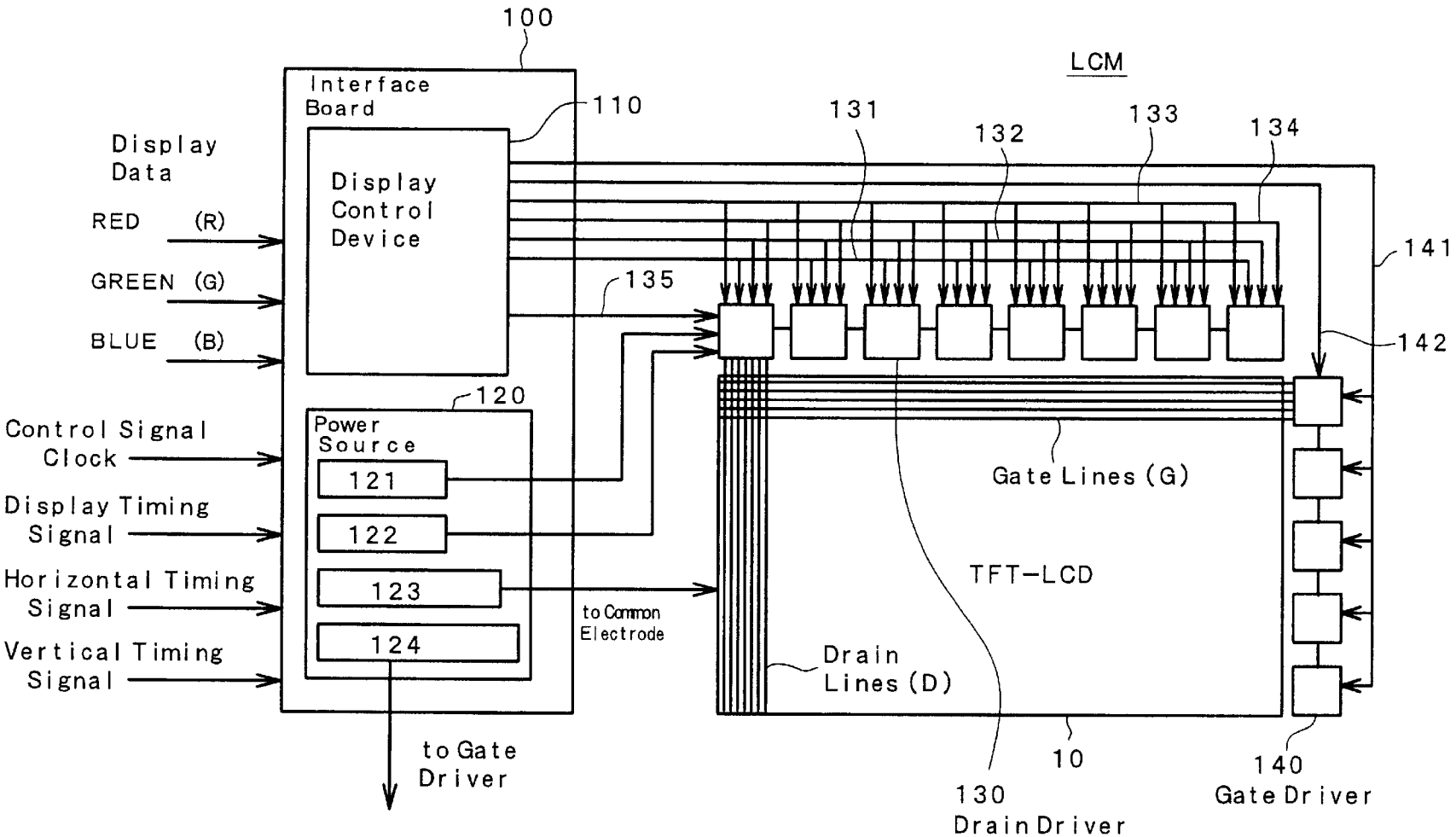
FIG. 1 is a block diagram showing an outline of a liquid crystal display device (liquid crystal display module) of the TFT type to which the invention is applied.

An explanation will be given of various embodiments of the invention with reference to the drawing as follows. Further, in all the drawings of the various embodiments of the invention, members having the same functions are identified by the same reference notations and repetitive explanation thereof will be omitted.

(Embodiment 1)

(Basic constitution of display device to which the invention is applied)

FIG. 1 is a block diagram showing an outline of a liquid crystal display device of the TFT type to which the invention is applied. In the liquid crystal display device (LCM) shown in FIG. 1, a drain driver 130 is arranged on an upper side of an liquid crystal display panel (TFT-LCD) 10 and a gate driver 140 and an interface unit 100 are arranged at respective lateral sides of the liquid crystal display panel 10.

The interface unit 100 is mounted on an interface board; while, the drain driver 130 and the gate driver 140 are also mounted respectively on an exclusive TCP (Tape Carrier Package) or directly on the liquid crystal display panel.

(Constitution of the liquid crystal display panel 10 shown in FIG. 1)

Figure 2:
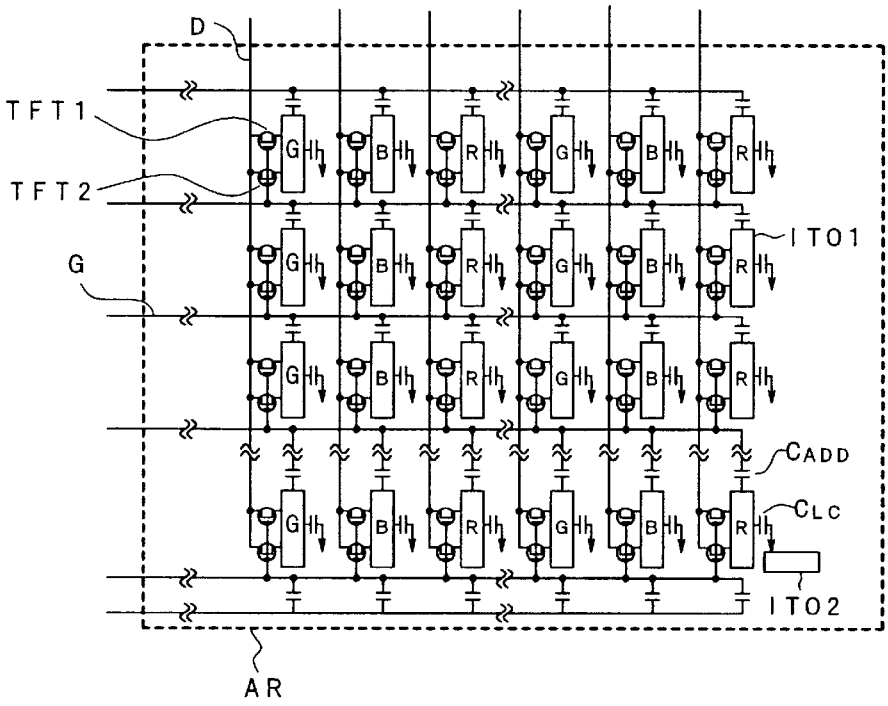
FIG. 2 is an equivalent circuit diagram of an example of the liquid crystal display device shown in FIG. 1.

FIG. 2 is an equivalent circuit representing an example of the liquid crystal display panel 10 shown in FIG. 1. As shown by FIG. 2, the liquid crystal display panel 10 is provided with a plurality of pixels disposed in a matrix arrangement. Each of the pixels is arranged in an area in which two contiguous signal lines (drain signal lines (D) or gate signal lines (G)) and two contiguous signal lines (gate signal lines (G) or drain signal lines (D)) intersect with each other. Each of the pixels is provided with thin film transistors (TFT1, TFT2), and source electrodes of the thin film transistors (TFT1, TFT2) of each of the pixels are connected to a pixel electrode (IT01). Further, a liquid crystal layer is provided between the pixel electrode (IT01) and a common electrode (IT02); and, accordingly, a liquid crystal capacitance (CLC) is equivalently connected between the pixel electrode (IT01) and the common electrode (IT02). Also, an added capacitor (CADD) is connected between the source electrodes of the thin film transistors (TFT1, TFT2) and the gate signal line (G) of a preceding stage.

Figure 3:
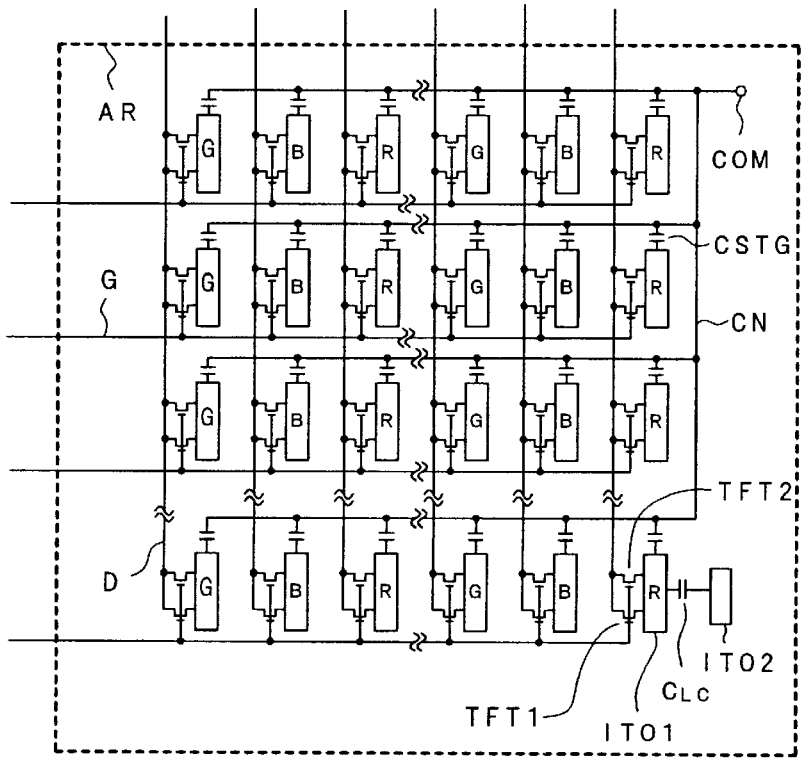
FIG. 3 is an equivalent circuit diagram of other example of the liquid crystal display panel shown in FIG. 1.

FIG. 3 is an equivalent circuit of other example of the liquid crystal display panel 10 shown in FIG. 1. Although the equivalent circuit shown in FIG. 2 has the added capacitor (CADD) formed between the gate signal line (G) at the preceding stage and the source electrodes, in the equivalent circuit shown in FIG. 3, a hold capacitor (CSTG) is provided between a common signal line (COM) and source electrodes, which is a point of difference therebetween. Although the invention is applicable to both equivalent circuits, in the former system, a pulse of the gate signal line at the preceding stage is inputted to the pixel electrode (IT01) via the added capacitance (CADD), whereas according to the latter system, there is no such input; and, accordingly, an even more excellent display can be obtained.

Further, FIG. 2 and FIG. 3 show equivalent circuits of liquid crystal display panels of the vertical electric field type, and in FIG. 2 and FIG. 3, notation AR designates a display area. Although FIG. 2 and FIG. 3 are circuit diagrams, the circuit diagrams are illustrated in correspondence with an actual physical geometrical arrangement of the elements.

According to the liquid crystal display panel 10 shown in FIG. 2 and FIG. 3, drain electrodes of the thin film transistors (TFT) of the respective pixels arranged in a column direction are respectively connected to drain signal lines (D), and the respective drain signal lines (D) are connected to the drain drivers (130) for applying grayscale voltages to liquid crystals of the respective pixels in the column direction. Further, gate electrodes of the thin film transistors (TFT) in the respective pixels arranged in a row direction, are respectively connected to the gate signal lines (G), and the respective gate signal lines (G) are connected to the gate drivers 140 for supplying scan drive voltages (positive bias voltages or negative bias voltages) to the gate electrodes of the thin film transistors (TFT) of the respective pixels in the row direction during one horizontal scan time period.

(Outline of constitution and operation of the interface unit 100 shown in FIG. 1)

The interface unit 100 shown in FIG. 1 is constituted by a display control device 110 and a power source circuit 120. The display control device 110 is constituted by a single semiconductor integrated circuit (LSI) for controlling the drive of the drain drivers 130 and the gate drivers 140 based on respective display control signals of a clock signal, a display timing signal, a horizontal timing signal and a vertical timing signal and data for display Ⓡ·G·B) transmitted from the computer main body. When the display control device 110 is supplied with the display timing signal, the display control device 110 uses the display timing signal to determine a display start position, outputs a start pulse (display data input start signal) to a first one of the drain drivers 130 via a signal line 135 and outputs received display data of a simple one row to the drain drivers 130 via a bus line 133 of display data. On this occasion, the display control device 110 outputs a clock (CL2) for latching display data, which is a display control signal for latching display data at data latching circuits of the respective drain drivers 130 (hereinafter, simply referred to as clock (CL2)).

The display data from the computer main body is constituted by 6 bits and is transferred at every unit time with one pixel unit, that is, respective data of red (R), green (G) and blue (B) as one set. Further, the latch operation of the data latch circuit in the first one of the drain drivers 130 is controlled by the start pulse inputted to the first one of the drain drivers 130. When the latch operation of the data latch circuit in the first one of the drain drivers 130 has been finished, the start pulse from the first one of the drain drivers 130 is inputted to a second one of the drain drivers 130, and the latch operation of the data latch circuit in the second one of the drain drivers 130 is controlled. Thereafter, similarly, the latch operation of the data latch circuits in the respective drain drivers T30 is controlled to thereby prevent erroneous display data from being written to the data latch circuits.

When input of the display timing signal has been finished, or a predetermined constant time period has elapsed from input of the display timing signal, the display control device 110 determines that one horizontal amount of the display data has been finished, and outputs an output timing control clock (CL1) (hereinafter, simply referred to as clock (CL1)), which is a display control signal for outputting display data stored in the data latch circuits in the respective drain drivers 130 to the drain signal lines (D) of the liquid crystal display panel 10, to the respective drain drivers 130 via a signal line 132.

After inputting the vertical timing signal, when a first one of the display timing signals is inputted, the display control device 110 determines that the first display timing signal corresponds to a first one of the display lines, and outputs a frame start instruction signal to the gate driver 140 via a signal line 142. Based on the horizontal timing signal, the display control device 110 outputs a clock (CL3) which is a shift clock of one horizontal scan time period to the gate drivers 140 via a signal line 141 such that a positive bias voltage is successively applied to the respective gate signal lines (G) of the liquid crystal display panel 10 at every horizontal scan time period. Thereby, the plurality of thin film transistors (TFT) connected to the respective gate signal lines (G) of the liquid crystal display panel 10 are switched during one horizontal scan time period.

By the above-described operation, an image is displayed on the liquid crystal display panel 10.

(Constitution of the power source circuit 120 shown in FIG. 1)

The power source circuit 120 shown in FIG. 1 is constituted by a positive voltage generating circuit 121, a negative voltage generating circuit 122, a common voltage (opposed electrode) voltage generating circuit 123 and a gate electrode voltage generating circuit 124.

The positive voltage generating circuit 121 and the negative voltage generating circuit 122 are respectively constituted by series resistance voltage dividing circuits; and, the positive voltage generating circuit 121 outputs five values of grayscale reference voltages (V"0 through V"4) having a positive polarity, while the negative voltage generating circuit 122 outputs five values of grayscale reference voltages (V"5 through V"9) having a negative polarity. The grayscale reference voltages (V"0 through V"4) having a positive polarity and the grayscale reference voltages (V"5 through V"9) having a negative polarity are supplied to the respective drain drivers 130. Further, the respective drain drivers 130 are supplied with alternating signals (timing signals for changing polarity of liquid crystal drive voltage; M) from the display control device 110 via a signal line 134. The common electrode voltage generating circuit 123 generates a drive voltage applied to the common electrode (IT02), and the gate electrode voltage generating circuit 124 generates drive voltages (positive bias voltage and negative bias voltage) applied to the gate electrodes of the thin film transistors (TFT).

(An alternating driving method of the liquid crystal display device shown in FIG. 1)

Generally, when a liquid crystal layer is supplied with same voltage (direct current voltage) for a long period of time, the inclination of the liquid crystal layer is fixed and as a result, a residual image phenomenon is caused and the life of the liquid crystal layer is shortened. In order to prevent this phenomenon, according to the liquid crystal display device, a voltage applied to the liquid crystal layer is alternated at every constant time period, that is, with a voltage applied to the common electrode as a reference, a voltage applied to the pixel electrode is changed to a positive voltage side/negative voltage side at every constant time period.

As a drive method for applying an alternating current voltage to the liquid crystal layer, there are two known methods, i.e., of a common symmetry method and a common inversion method. The common inversion method is a method of alternately inverting the voltage applied to the common electrode and the voltage applied to the pixel electrode positively and negatively. On the other hand, the common symmetry method is a method of inverting the voltage applied to the pixel electrode alternately positively and negatively with reference to the voltage applied to the common electrode while keeping the voltage applied to the common electrode constant. The common symmetry method has a drawback in that the amplitude of the voltage applied to the pixel electrode (IT01) becomes twice as much as that in the case of the common inversion method, so that a driver having a low withstand voltage cannot be used unless a liquid crystal having low threshold voltage is developed; however, the dot inversion method or an N line inversion method, which have an excellent low power consumption and display quality, can be used to avoid this problem.

Figure 4:
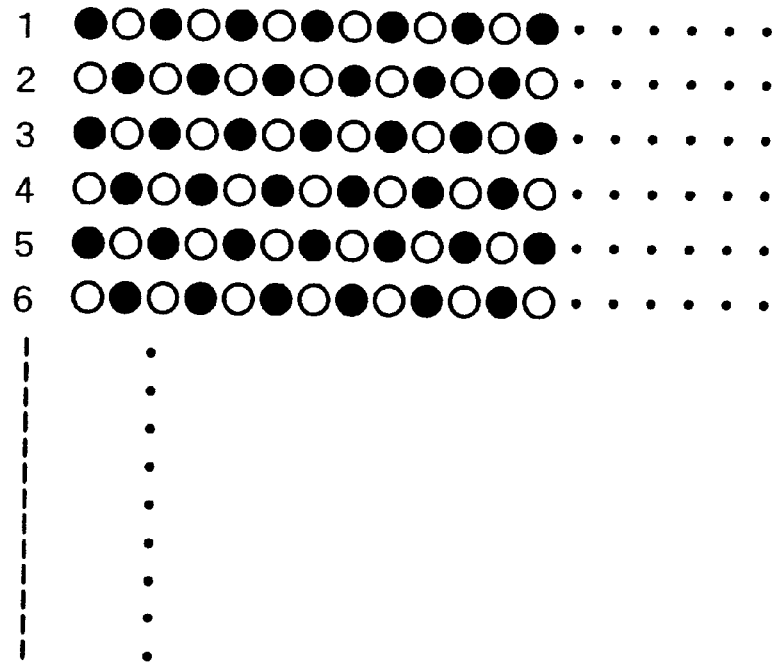
FIG. 4 is a diagram illustrating the polarity of a liquid crystal drive voltage outputted from a drain driver to drain signal lines (D) when a dot inversion method is used as a method of driving a liquid crystal display device.
Figure 4:
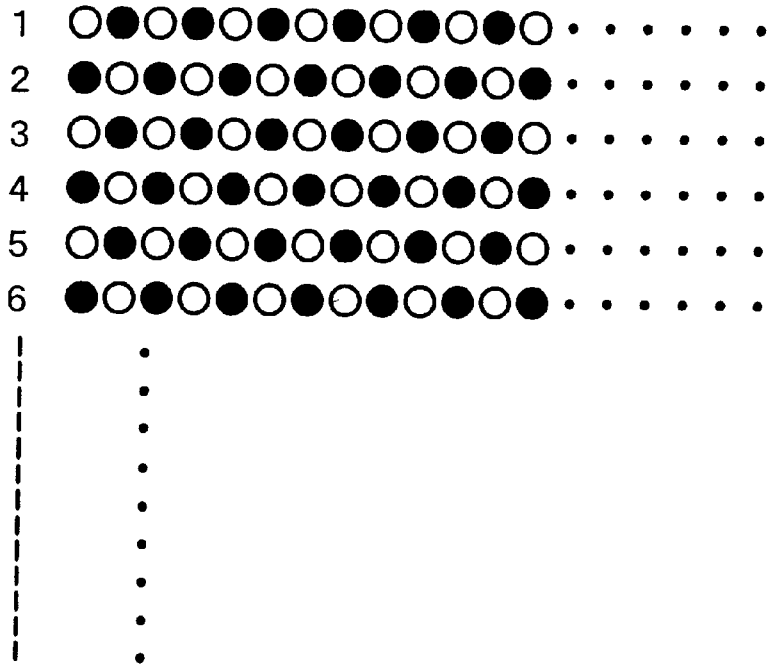

In the liquid crystal display device shown in FIG. 1, as its driving method, there is used the dot inversion method. FIG. 4 is a drawing illustrating the polarity of the liquid crystal drive voltage outputted from the drain drivers 130 to the drain signal lines (D) (that is, grayscale voltages applied to the pixel electrodes (IT01)) when the dot inversion method is used as a method of driving the liquid crystal display device.

When the dot inversion method is used as the method of driving the liquid crystal display device, as shown in FIG. 4, for example, at odd number lines of odd frames, a liquid crystal drive voltage (designated by ● in FIG. 4), having a polarity negative relative to the liquid crystal drive voltage (VCOM) applied to the common electrode (IT02), is applied from the drain driver 130 to the drain signal line (D) at an odd number order; while, a liquid crystal drive voltage (shown by ○ in FIG. 4), having a polarity positive relative to the liquid crystal drive voltage (VCOM) applied to the common electrode (IT02), is applied to the drain signal line (D) of an even number order. At an even number line of an odd number frame, a liquid crystal drive voltage having positive polarity is applied from the drain driver 130 to the drain signal line (D) of an odd number order; while, a liquid crystal drive voltage having negative polarity is applied to the drain signal line (D) of an even number order.

The polarities at respective lines are inverted at every frame, that is, as shown in FIG. 4, at an odd number fine of an even number frame, a liquid crystal drive voltage having a positive polarity is applied from the drain driver 30 to the drain signal (D) of an odd number order, while a liquid crystal drive voltage having a negative polarity is applied to the drain signal line (D) of an even number order. Further, at an even number line of an even number frame, a liquid crystal drive voltage having a negative polarity is applied from the drain driver 130 to the drain signal line (D) of an odd number order, while a liquid crystal drive voltage having a positive polarity is applied to the drain signal line (D) of an even number order.

By using the dot inversion method, voltages applied to the contiguous drain signal lines (D) are inverse to each other; and, accordingly, current flowing in the gate electrodes of the common electrode (IT02) and the thin film transistor (TFT) are canceled by contiguous ones thereof and power consumption can be reduced. Further, the current flowing in the common electrode (IT02) is insignificant and the voltage drop is not considerable; accordingly, the voltage level of the common electrode (IT02) is stabilized and deterioration of the display quality can be minimized.

(Constitution of the drain driver 130 shown in FIG. 1)

Figure 5:
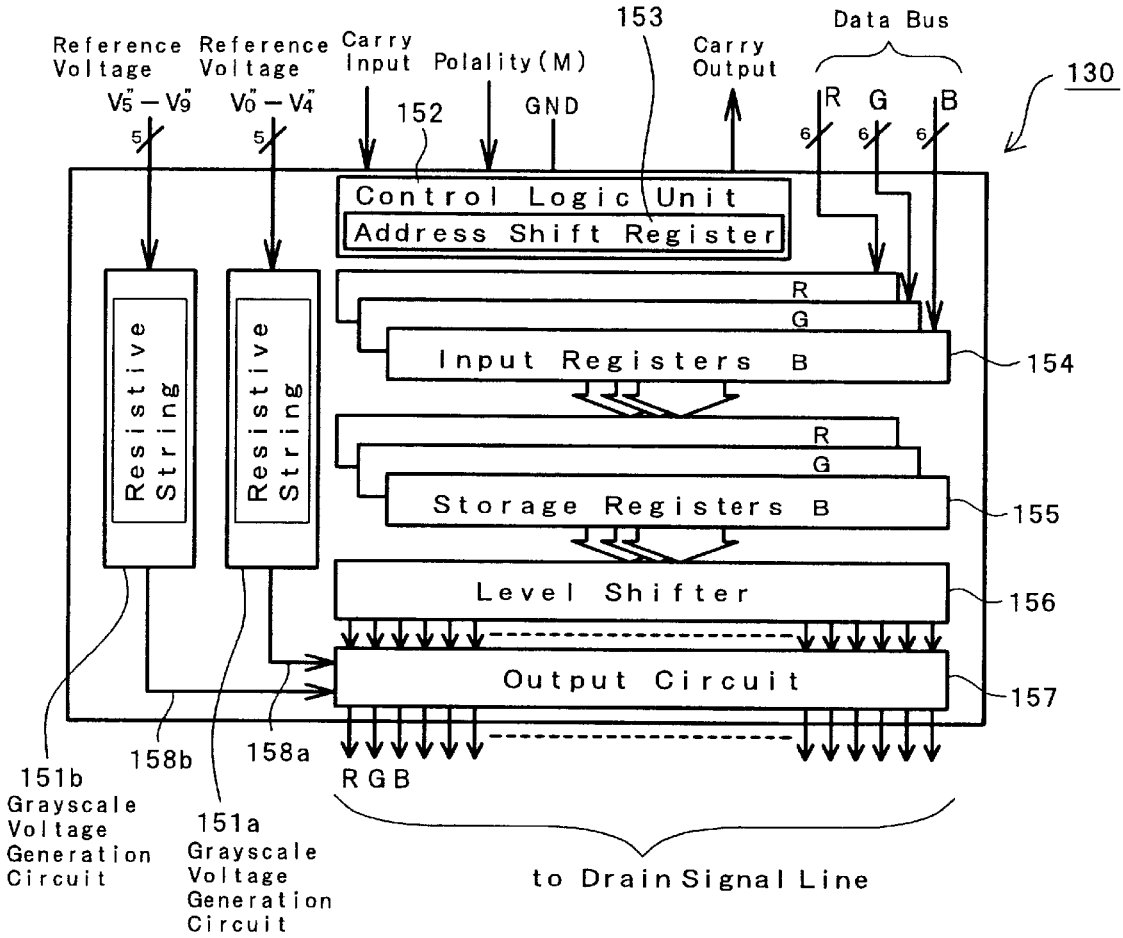
FIG. 5 is a block diagram showing an outline of an example of a drain driver shown in FIG. 1.

FIG. 5 is a block diagram showing an outline of an example of the drain driver 130 shown in FIG. 1. The drain drivers 130 are constituted by a single semiconductor integrated circuit (LSI). In the drawing, a positive grayscale voltage generation circuit 151*a* generates sixty-four grayscale levels of positive grayscale voltages based on five values of grayscale reference voltages (V"0 through V"4) having a positive polarity inputted from the positive voltage generation circuit 121 and outputs the grayscale voltages to an output circuit 157 via a voltage bus line 158*a*. A negative grayscale voltage generation circuit 151*b* generates sixty-four grayscale levels of negative grayscale voltages based on five values of grayscale reference voltages (V"5 through V"9) having a negative polarity inputted from the negative voltage generation circuit 122 and outputs the grayscale voltages to the output circuit 157 via a voltage bus line 158*b*.

An address shift register 153 in a control logic circuit 152 of the drain driver 130 generates a data input signal of an input register 154 based on clock (CL2) inputted from the display control device 110 and outputs the signal to the input register 154. The input register 154 latches display data of six bits for each color by a number of outputs based on the data input signal outputted from the shift register 153 in synchronism with the clock (CL2) inputted from the display control device 110.

A storage register 155 latches display data in the input register 154 in accordance with clock (CL1) inputted from the display control device 110. The display data inputted to the storage register 155 is inputted to the output circuit 157 via a level shifter 156. The output circuit 157 selects one grayscale voltage (one grayscale voltage in 64 grayscale levels) in correspondence with the display data based on sixty-four grayscale levels of positive grayscale voltages, or sixty-four grayscale levels of negative grayscale voltages and outputs the selected grayscale voltage to the respective drain signal line (D).

Figure 6:
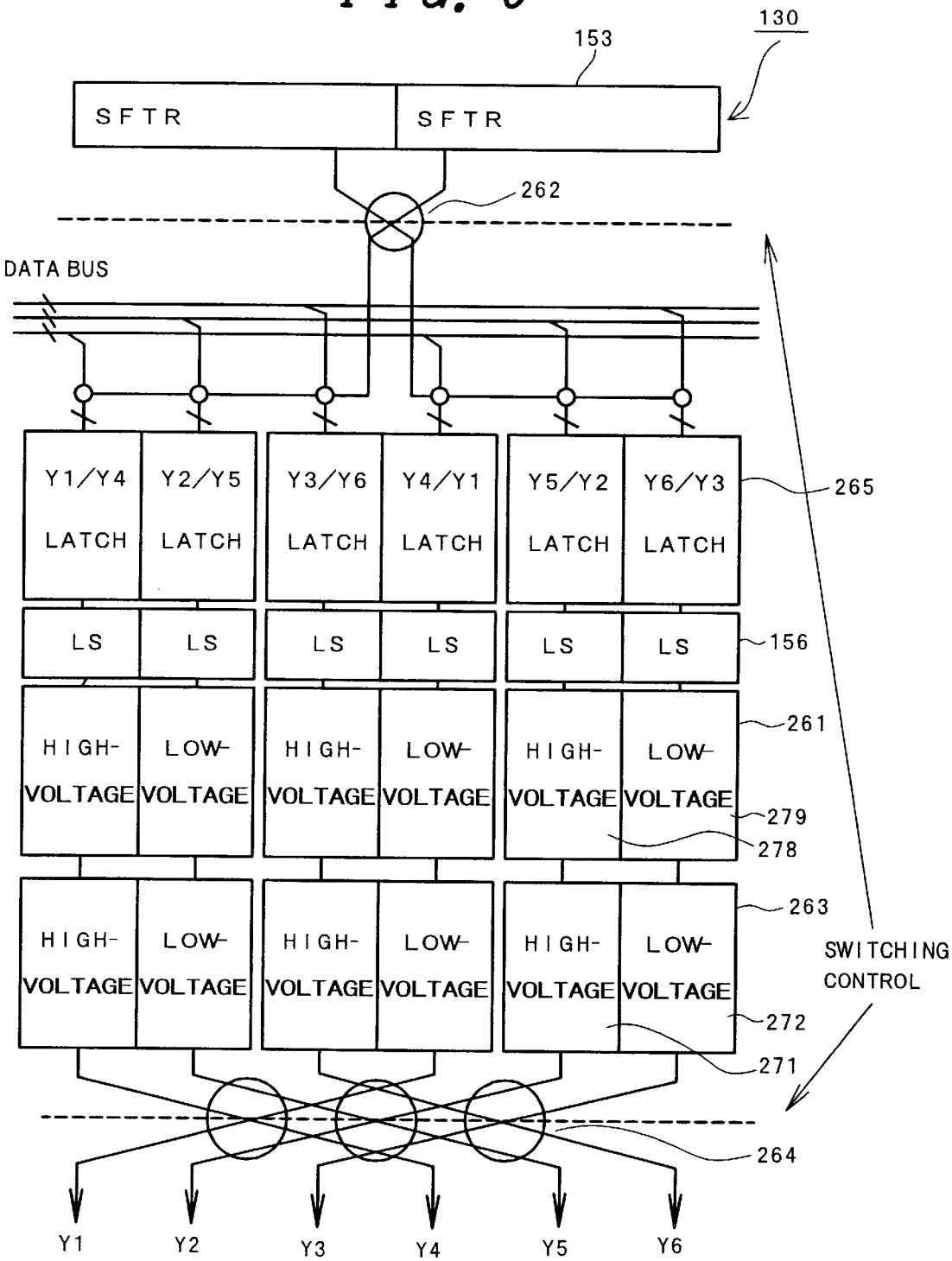
FIG. 6 is a block diagram of the drain driver shown in FIG. 5 centering on the constitution of an output circuit.

FIG. 6 is a block diagram of the drain driver 130 shown in FIG. 5 centering on the constitution of the output circuit 157. In the drawing, numeral 153 designates the shift register 153 in the control logic circuit 152 shown in FIG. 5, and numeral 156 designates the level shifter shown in FIG. 5. A data latch unit 265 represents the input register 154 and the storage register 155 shown in FIG. 5; while, a decoder unit (grayscale voltage selecting circuit) 261 and switch units (2) 264 for switching outputs from an amplifier couple 263, constitute the output circuit 157 shown in FIG. 5. In this case, a switch unit (1) 262 and the switch units (2) 264 are controlled based on the alternating signal (M). Further, notations Y1, Y2, Y3, Y4, Y5 and Y6 respectively designates a first one, a second one, a third one, a fourth one, a fifth one and a sixth one of the drain signal lines (D).

According to the drain driver 130 shown in FIG. 6, by operation of the switch unit (1) 262, the data input signals inputted to the data latch units 265 (the input registers shown in FIG. 5) are switched and display data for respective colors are inputted to the contiguous data latch units 265 for respective colors. The decoder unit 261 is constituted by high voltage decoder circuits 278, each selecting a positive grayscale voltage in correspondence with display data outputted from the data latch unit 265 (further in details, the storage register 155 shown in FIG. 5) from sixty-four grayscale levels of grayscale voltages having a positive polarity outputted from the grayscale voltage generation circuit 151 a via the voltage bus line 158*a,* and low voltage decoder circuits 279, each selecting a negative grayscale voltage in correspondence with the display data outputted from the respective data latch unit 265 from sixty-four grayscale levels of grayscale voltages having a negative polarity outputted from the grayscale voltage generation circuit 151*b* via the voltage bus line 158*b.*

The high voltage decoder circuits 278 and the low voltage decoder circuits 279 are provided at respective contiguous ones of the data latch units 265. The amplifier couple 263 is constituted by a high voltage amplifier 271 and a low voltage amplifier 272. The high voltage amplifier 271 is supplied with a positive grayscale voltage generated by the high voltage decoder circuit 278 and the high voltage amplifier 271 outputs a positive grayscale voltage. The low voltage amplifier 272 is supplied with negative grayscale voltage generated by the low voltage decoder circuit 279 and the low voltage amplifier 272 outputs a negative grayscale voltage.

According to the dot inversion method, contiguous grayscale voltages of respective colors are inverse to each other, while, an arrangement of the high voltage amplifiers 271 and the low voltage amplifiers 272 of the amplifier couples 263 is constituted such that they are arranged high voltage amplifier 271→low voltage amplifier 272→high voltage amplifier 271→low voltage amplifier 272. Therefore, by operation of the switch unit (1) 262, the data input signals inputted to the data latch units 265 are switched and the display data for the respective colors is inputted to contiguous ones of the data latch units 265 for each respective color. In correspondence therewith, output voltages outputted from the high voltage amplifiers 271 or the low voltage amplifiers 272 are switched by the switch units (2) 264 and outputted to the drain signal lines (D) outputting grayscale voltages for each respective color, for example, the first one of the drain signal lines (Y1) and the fourth one of the drain signal lines (Y4). Thereby, positive or negative grayscale voltages can be outputted to the respective drain signal lines (D).

(Characteristic constitution of the liquid crystal display device according to the embodiment)

Figure 7:
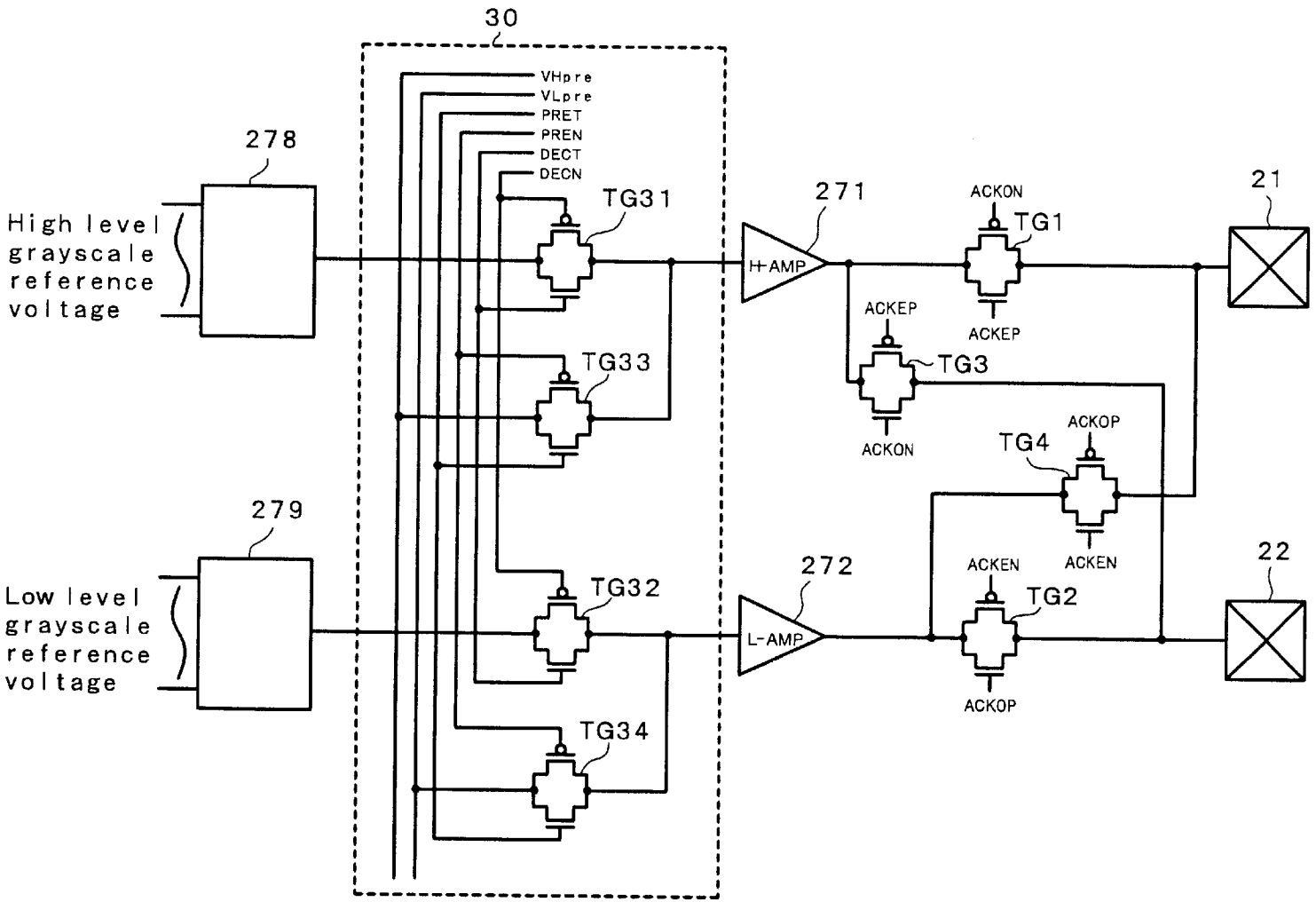
FIG. 7 is a diagram of a drain driver of a liquid crystal display device according to an embodiment of the present invention.

FIG. 7 is a drawing showing an outline of the drain driver 130 of the liquid crystal display device according to the embodiment. Further, FIG. 7 illustrates only the high voltage decoder circuit 278, the low voltage decoder circuit 279, the high voltage amplifier 271 and the low voltage amplifier 272 and output routes of outputting contiguous ones of the drain signals (D) for a respective color to, for example, the first one of the drain signal lines (Y1) and the fourth one of the drain signal lines (Y4). In FIG. 7, transfer gates (TG1 through TG4) constitute one switch circuit of the switch unit (2) 264 shown in FIG. 6. Further, output PADs (21, 22) show output PADs of a semiconductor chip (drain driver) for outputting signals to the first one of the drain signal line (Y1) and the fourth one of the drain signal line (Y4).

As shown by the drawing, the liquid crystal display device according to the embodiment is characterized by provision of a precharge control circuit (hereinafter, simply referred to as a precharge circuit) 30 between the high voltage decoder circuit 278 and the high voltage amplifier 271, as well as between the low voltage decoder circuit 279 and the low voltage amplifier 272.

The precharge circuit 30 is provided with a transfer gate circuit (TG31) connected between the high voltage decoder circuit 278 and the high voltage amplifier 271, and a transfer gate circuit (TG34) connected between the low voltage decoder circuit 279 and the low voltage amplifier 272. The transfer gates (TG31, TG32) are controlled by control signals (DECT, DECN) and separate the high voltage decoder circuit 278 and the low voltage decoder circuit 279 from the high voltage amplifier 271 and the low voltage amplifier 272 during a precharge time period. Further, the precharge circuit 30 is provided with a transfer gate (TG33) and a transfer gate (TG34). The transfer gate circuits (TG33, TG34) are controlled by control signals (PRET, PREN) and supply a precharge voltage for a high voltage (for example, arbitrary grayscale reference voltage, arbitrary positive grayscale voltage) (VHpre) to the high voltage amplifier 271 and supply a precharge voltage for a low voltage (for example, arbitrary grayscale reference voltage, arbitrary negative grayscale voltage) (VLpre) to the low voltage amplifier 272 during the precharge time period.

(Output delay time period (tDD) characteristic of the drain driver 130 according to the embodiment)

Figure 8A:
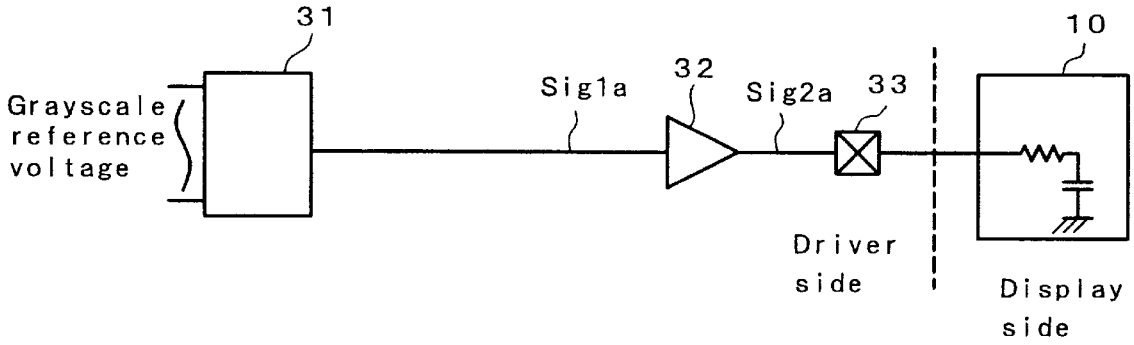
FIG. 8*a* is a circuit diagram illustrating the output delay time period (tDD) characteristic of the drain driver of the liquid crystal display device shown in FIG. 1.
Figure 8B:
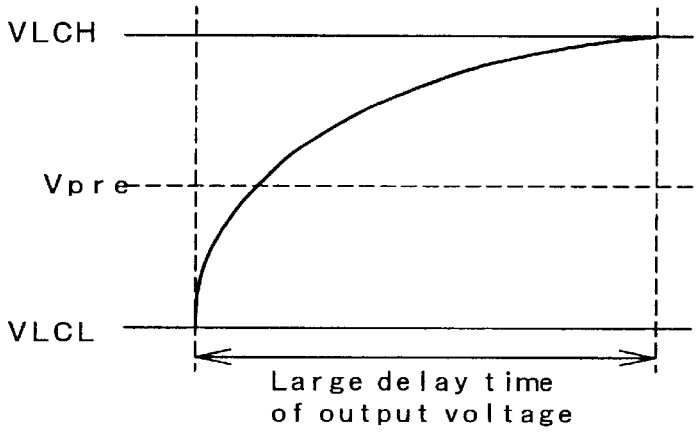
FIG. 8*b* is a voltage waveform diagram illustrating the output delay time period (tDD) characteristic of the liquid crystal display device shown in FIG. 1.

FIGS. 8*a* and 8*b* illustrate the output delay time period (tDD) characteristic of the drain driver 130 of the liquid crystal display device shown in FIG. 1. Further, in FIG. 8*a,* only one output route is illustrated, and the switch unit (2) 264 shown in FIG. 6 is ornitted. That is, in FIG. 8*a,* a decoder 31 indicates the high voltage decoder circuit 278 or the low voltage, decoder circuit 279, an amplifier 32 indicates the high voltage amplifier 271 or the low voltage amplifier 272 shown in FIG. 6, and an output PAD 33 indicates the output PAD (20) or the output PAD (21) shown in FIG. 7.

Figure 9:
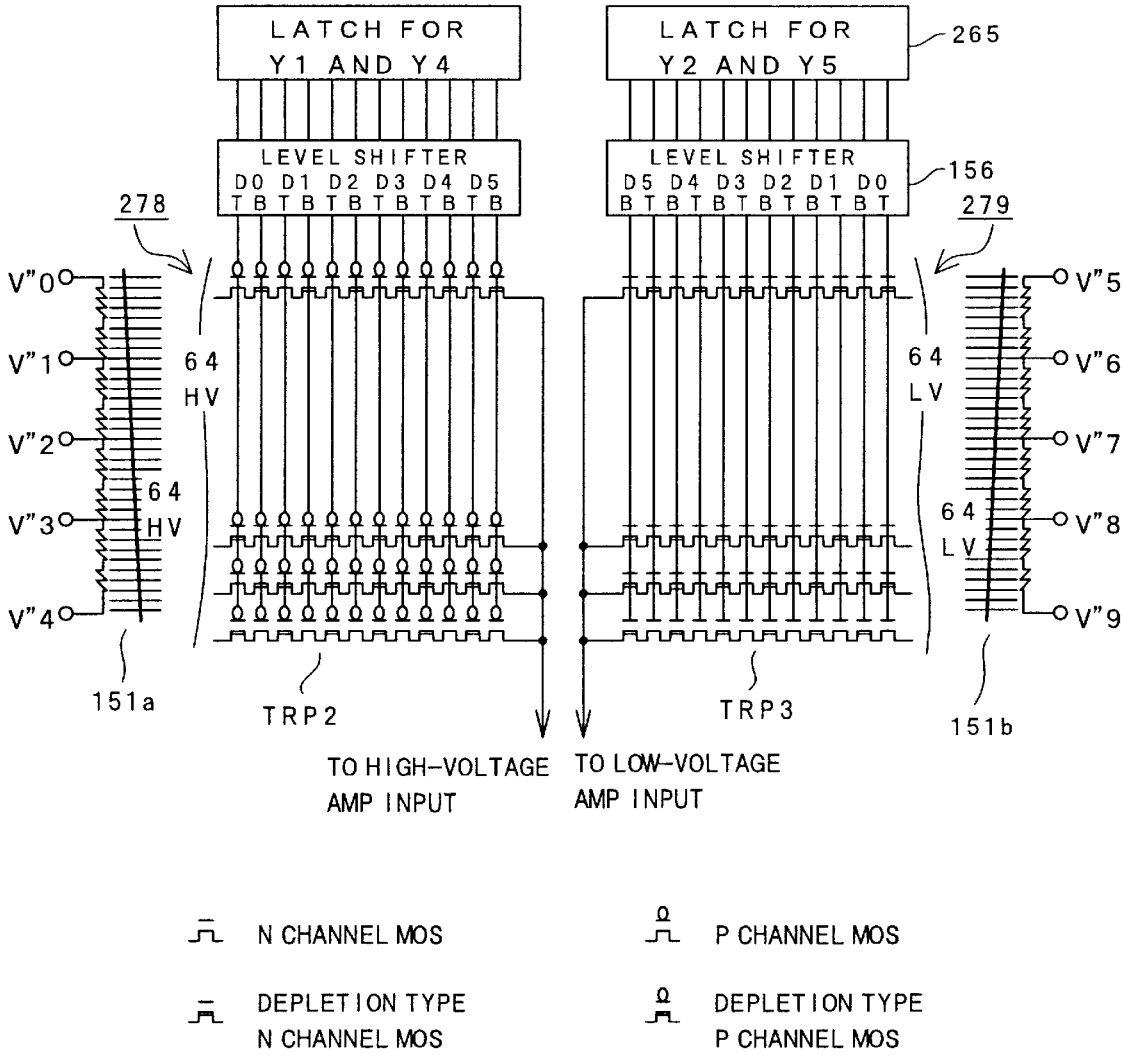
FIG. 9 is a schematic diagram of an example of a decoder circuit for high voltage and a decoder circuit for low voltage shown in FIG. 6.

FIG. 9 shows an example of the high voltage decoder circuit 278 and the low voltage decoder circuit 279 shown in FIG. 6. The high voltage decoder circuit 278 and the low voltage decoder circuit 279 shown in FIG. 6 are constituted by transistor rows (TRP2, TRP3) connected in series with enhancement MOS transistors and depletion MOS transistors. As described above, for the purpose of narrow frame edge formation, the chip of the semiconductor chip constituting the drain driver 130 is further reduced; and, in accordance therewith, the high voltage decoder circuit 278 and the low voltage decoder circuit 279 are constituted by MOS transistors having a minimum size of the semiconductor chip constituting the drain driver 130. As a result, the current drive function of the high voltage decoder circuit 278 and the low voltage decoder circuit 279 is lowered.

The high voltage amplifier 271 and the low voltage amplifier 272 are connected to outputs of the high voltage decoder circuit 278 and the low voltage decoder circuit 279, and the high voltage amplifier 271 and the low voltage amplifier 272 are provided with large input impedance. Therefore, the time period until outputs of the high voltage decoder circuit 278 and the low voltage decoder circuit 279

(hereinafter, simply referred to as output delay time period of decoder) can be determined becomes considerable, and the output delay time period of the decoders is further increased by the high voltage amplifier 271 and the low voltage amplifier 272. As a result, as shown in FIG. 8*b,* a time period until the grayscale voltage (VLCH) is outputted in correspondence with display data to the drain signal line (D) (hereinafter, simply referred to as output delay time period (tDD) of drain driver) is increased.

Figure 10A:
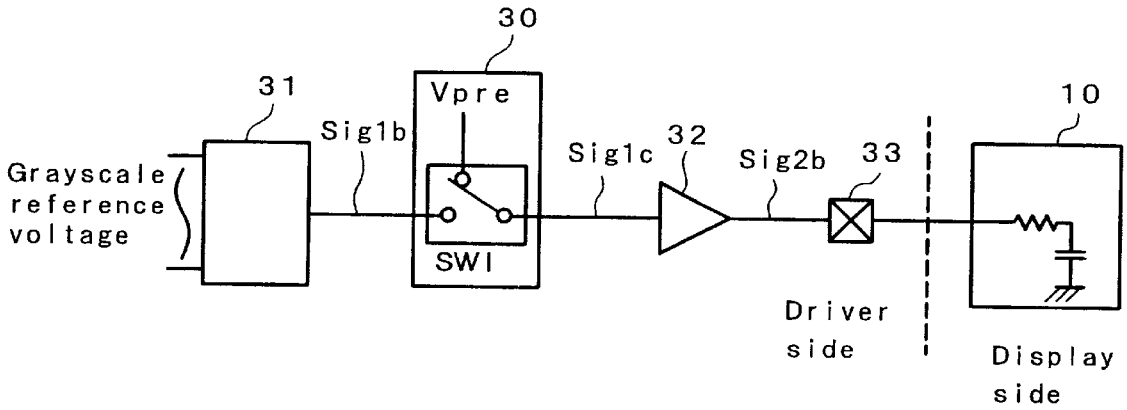
FIG. 10*a* is a circuit diagram illustrating the output delay time period (tDD) characteristic of a drain driver of the liquid crystal display device according to an embodiment of the invention.
Figure 10B:
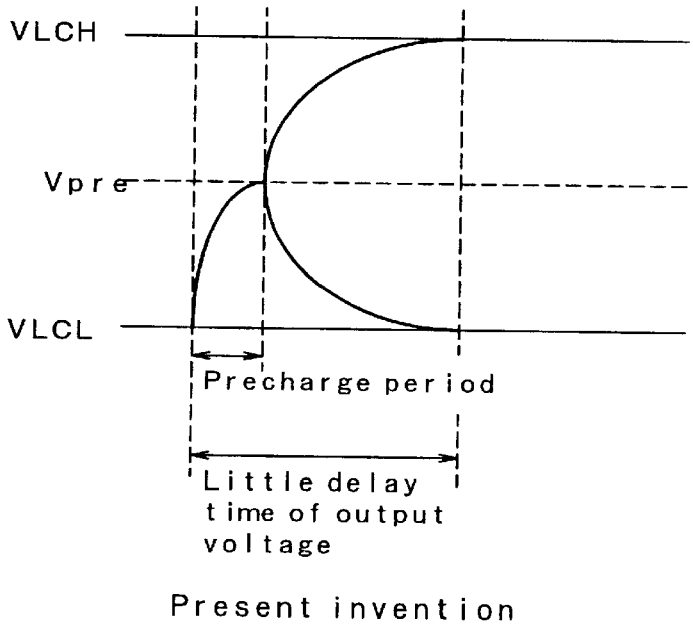
FIG. 10*b* is a voltage waveform diagram illustrating the output delay time period (tDD) of the drain driver of the liquid crystal display device according to the embodiment of the invention.

FIGS. 10*a* and 10*b* illustrate the output delay time period (tDD) characteristic of the drain driver 130 of the liquid crystal display device according to the present invention. In FIG. 10*a,* only one output route is illustrated, and the switch unit (2) 264 shown in FIG. 6 is omitted. That is, in FIG. 10*a,* the decoder circuit 31 indicates the high voltage decoder circuit 278 or the low voltage decoder circuit 279 shown in FIG. 7, the amplifier 32 indicates the high voltage amplifier 271 or the low voltage amplifier 272 shown in FIG. 7 and the output PAD 33 indicates the output PAD (20) or the output PAD (21) shown in FIG. 7.

According to the liquid crystal display device of this embodiment, during the precharge time period, the high voltage decoder circuit 278 and the low voltage decoder circuit 279 are separated from the high voltage amplifier 271 and the low voltage amplifier 272, and the transfer gate (TG31) and the transfer gate (TG32) are connected to the outputs of the high voltage decoder circuit 278 and the low voltage decoder circuit 279. The input impedance of the transfer gates (TG31, TG32) in OFF time is far smaller than the input impedance of the high voltage amplifier 271 and the low voltage amplifier 272. Therefore, outputs from the high voltage decoder circuit 278 and the low voltage decoder circuit 279 are determined by a time earlier than that in the case shown by FIG. 8*b,* and, as a result, the output delay time period of the decoder can be reduced.

Further, during the precharge time period, the high voltage amplifier 271 and the low voltage amplifier 272 are supplied with the precharge voltage (VHpre) for the high voltage and the precharge voltage (VLpre) for the low voltage; and, accordingly, the drain signal lines (D) are previously charged with the precharge voltage (VHpre) for the high voltage and the precharge voltage (VLpre) for the low voltage.

Precharge from the high voltage amplifier 271 and the low voltage amplifier 272 to the drain signal lines (D) is carried out in parallel with the high voltage decoder circuit 278 and the low voltage decoder circuit 279. Further, after finishing the precharge time period, the high voltage amplifier 271 and the low voltage amplifier 272 follow the outputs from the high voltage decoder circuit 278 and the low voltage decoder circuit 279 and a grayscale voltage (VLCH) in correspondence with display data is outputted to the drain signal line (D). As a result, as shown by FIG. 10*b,* according to the embodiment, the output delay time period (tDD) of the drain driver can be made smaller than that in the case shown by FIG. 8*b.*

According to the dot inversion method, the polarity of the grayscale voltage applied to the liquid crystal layer of each respective pixel is inverted at every frame. Therefore, as in the embodiment, by charging the drain signal lines (D) in the precharge time period with the precharge voltage (VHpre) for the high voltage or the precharge voltage (VLpre) for the low voltage, after completion of the precharge time period, the potential of the drain signal line (D) can swiftly follow the grayscale voltage (VLCH) in correspondence with the display data. Further, according to the embodiment, as shown in FIG. 10*b,* even with a grayscale voltage (VLCH) in correspondence with the display data outputted to the drain signal line (D), the output delay time period (tDD) of the drain driver can be made smaller than that in the case of FIG. 8*b.*

A liquid crystal display device provided with a precharge circuit at a prestage of an amplifier is described in Japanese Patent Laid-Open No. 337400/1994 or Japanese Patent Laid-Open No. 187100/1998. However, according to the devices described in these publications, the precharge circuits are provided to prevent charge and discharge time periods to and from a sampling capacitor from becoming deficient. Therefore, the devices in the publications do not prevent the current drive functions of the high voltage decoder circuit 278 and the low voltage decoder circuit 279 from being lowered, nor do they prevent the output delay time period (tDD) of the drain driver from becoming large as a result of a necessity of constituting the high voltage decoder circuit 278 and the low voltage decoder circuit 279 by MOS transistors having a minimum size to achieve narrow frame edge formation, as in the present invention. Further, no mention is given to the above-described problems in these publications.

(Outline of operation of the precharge circuit 30 according to the embodiment)

Figure 11:
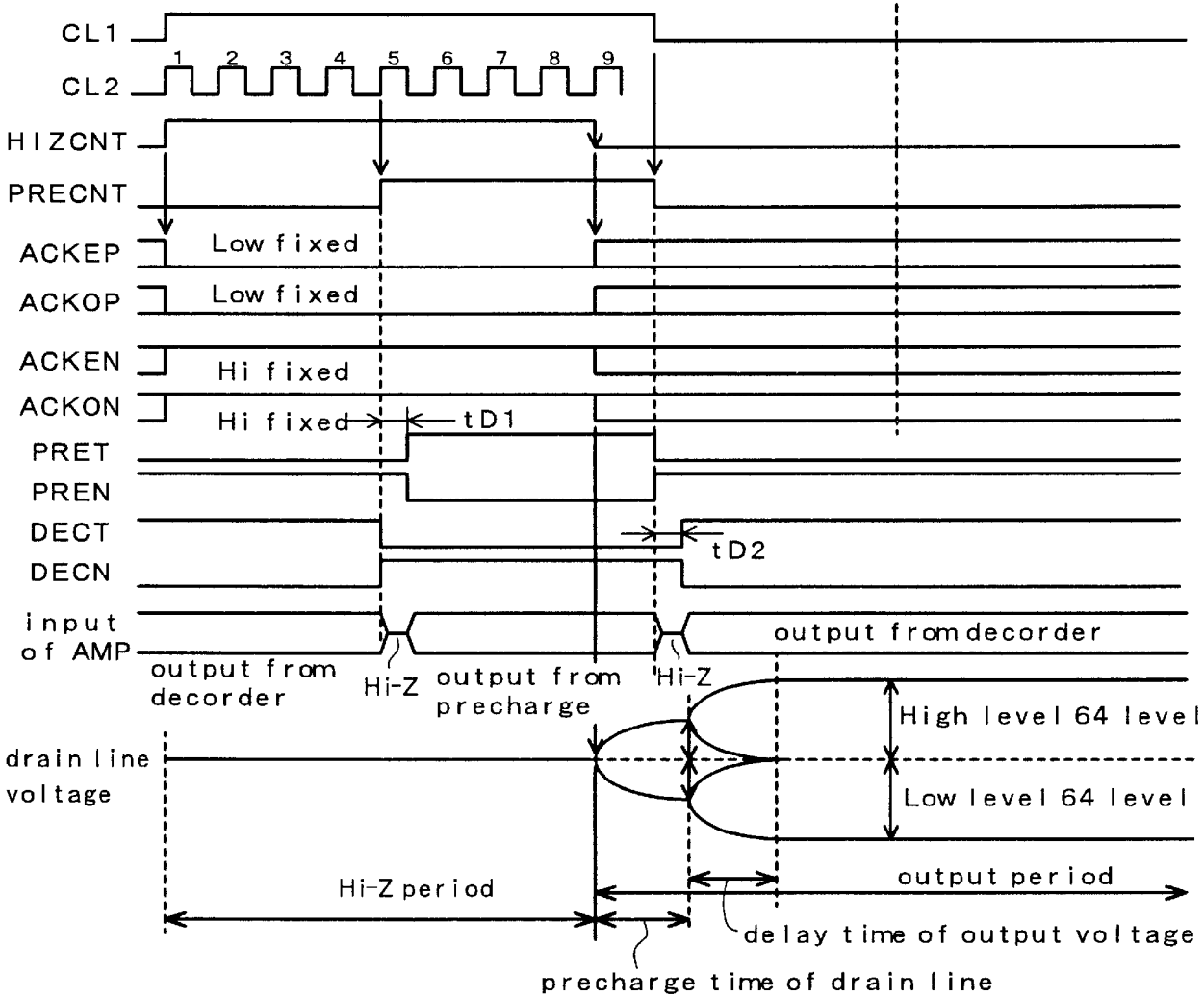
FIG. 11 is a timing chart illustrating the operation of a precharge circuit shown in FIG. 7.

FIG. 11 shows a timing chart of the operation of the precharge circuit 30 shown in FIG. 7.

A control signal (HIZCNT) is used for generating control signals (ACKEP, ACKOP, ACKEN, ACKON) applied to gate electrodes of the respective transfer gates (TG1 through TG4), and the control signal (HIZCNT) is a signal which becomes H level during 8 periods of clock (CL2) in a time period of High level (hereinafter, simply referred to as H level) of clock (CL1). In switching a scan line, both the high voltage amplifier 271 and the low voltage amplifier 272 are brought into an unstable state. The control signal (HIZCNT) is provided to prevent outputs of the respective amplifiers (271, 272) from being outputted to the respective drain signal lines (D). During a time period in which the control signal (HIZCNT) is at the H level, the control signals (ACKEP, ACKOP) become Low level (hereinafter, simply referred to as L level) and the control signals (ACKEN, ACKKON) become R level. Thereby, all of the respective transfer gates (TG1 through TG4) become OFF.

A control signal (PRECNT) is used for generating control signals (PRET, PREN, DECT, DECN) applied to the gate electrodes of the respective transfer gates (TG31 through TG34), as shown in FIG. 11, and it is a signal which becomes H level after 4 periods of clock (CL2) from the rise of the control signal (HIZCNT) and becomes L level at the fall of clock (CL1).

The control signal (DECT) changes from H level to L level before the control signal (PREN) and the control signal (DECN) change from L level to H level before the control signal (PRET). Thereby, first, the transfer gates (TG31, TG32) become OFF, and, thereafter, after a delay of (tD1), the transfer gates (TG33, TG34) become ON. Further, the control signal (PREN) is changed from L level to H level before the control signal (DECT) and the control signal (PRET) is changed from H level to L level before the control signal (DECN). Thereby, firstly, the transfer gates (TG33, TG34) become OFF, and, thereafter, after a delay of (tD2), the transfer gates (TG31, TG32) become ON.

Figure 12:
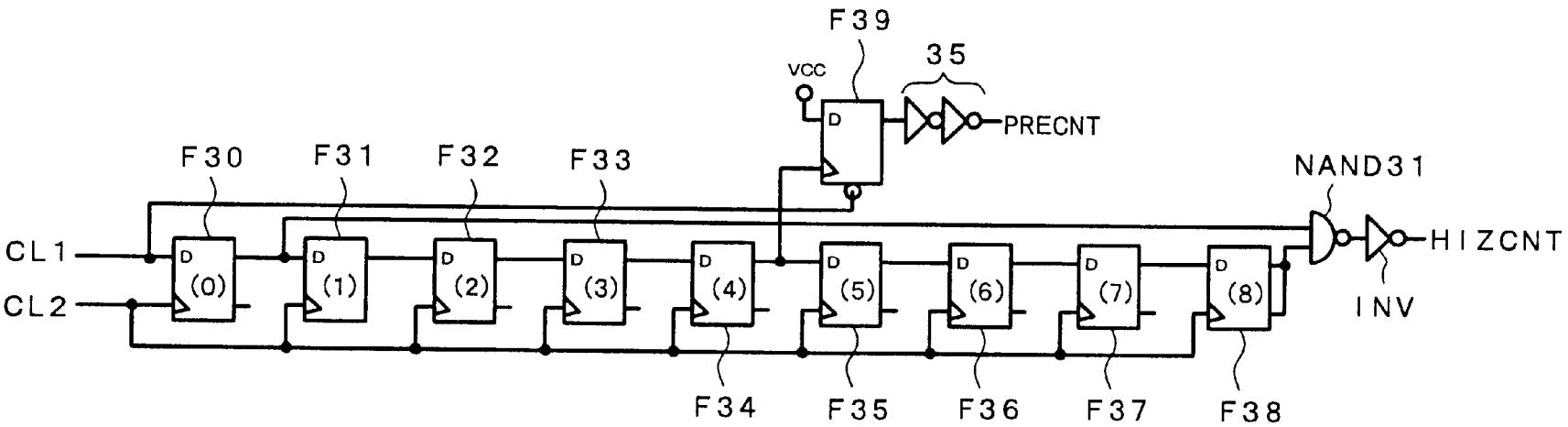
FIG. 12 is a schematic diagram of a circuit for generating a control signal (HIZCNT) and a control signal (PRECNT) shown in FIG. 11.

FIG. 12 is an example of the circuit for generating the control signal (HIZCNT) and the control signal (PRECNT) shown in FIG. 11.

According to FIG. 12, by means of a D type flip flop circuit (F30), a clock (CL1) is inputted in synchronism with clock (CL2) and a positive phase output of the D type flip flop circuit (F30) is successively inputted by respective D type flip flop circuits (F31 through F38) in synchronism with the clock (CL2). The positive phase output of the D type flip flop circuit (F38) is inputted to one input terminal of an NAND circuit (NAND31) and other input terminal of the NAND circuit (NAND31) is inputted with the positive phase output from the D type flip flop circuit (F30). Therefore, an output which becomes L level during 8 periods of the clock (CL2) is provided from the NAND circuit (NAND31) during a time period of H level of clock (CL1). By inverting an output of the NAND circuit (NAND31) using an inverter circuit (INV), the control signal (HIZCNT) shown in FIG. 11 is provided.

Further, an output of the D type flip flop circuit (F34) is inputted to a clock input terminal of a D type flip flop circuit (F39); and, accordingly, the D type flip flop circuit (F39) becomes H level in synchronism with the positive phase output of the D type flip flop circuit (F34). A reset terminal of the D type flip flop circuit (F39) is inputted with clock (CL1), and, accordingly, the D type flip flop circuit (F39) becomes L level in synchronism with fall of clock (CL1). Thereby, there is provided a signal which becomes H level after 4 time periods of clock (CL2) from the rise of the control signal (HIZCNT) and becomes L level at the fall of clock (CL1) from the D type flip flop circuit (F39). By delaying the signal by a predetermined time period using an inverter circuit group 35, the control signal (PRECNT) shown in FIG. 11 is provided.

Figure 13:
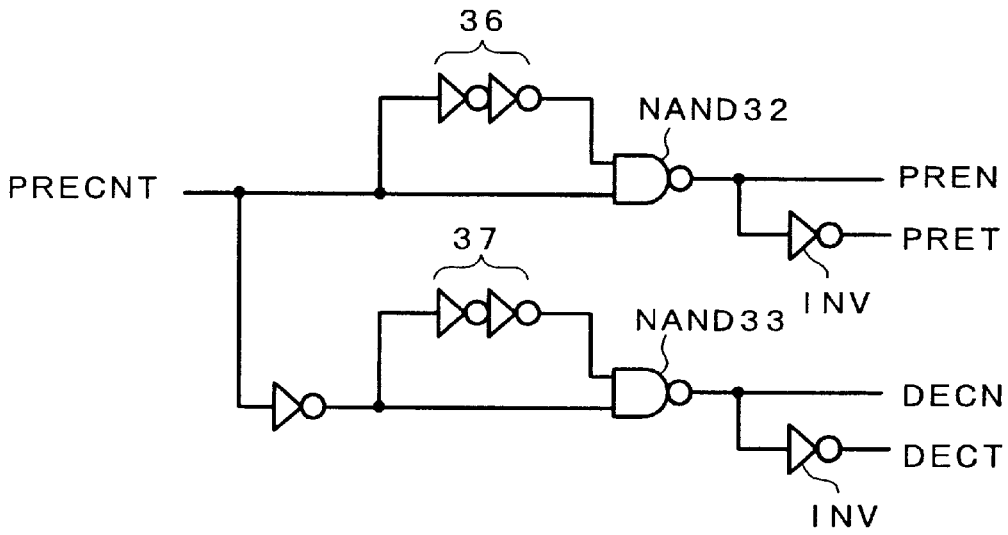
FIG. 13 is a schematic diagram of a circuit for generating control signals (PRET, PREN, DECT, DECN) shown in FIG. 11.

FIG. 13 shows an example of a circuit for generating the control signals (PRET, PREN, DECT, DECN) in FIG. 11.

According to the circuit shown in FIG. 13, by inputting the control signal (PRECNT) and the control signal (PRECNT), which is delayed by (tD1) by an inverter circuit group 36, to an NAND circuit (NAND32), the control signal (PRET) is generated, and by inverting the control signal (PRET) using an inverter circuit (INV), the control signal (PREN) is provided. Further, by inputting a control signal (/PRECNT), while is inverted by an inverter circuit (INV), and a control signal (/PRECNT), which is delayed by (tD2) using an inverter circuit group 37, to an NAND circuit (NAND33), the control signal (DECN) is generated and by inverting the control signal (DECN) using an inverter circuit (INV), the control signal (DECT) is provided.

Figure 14:
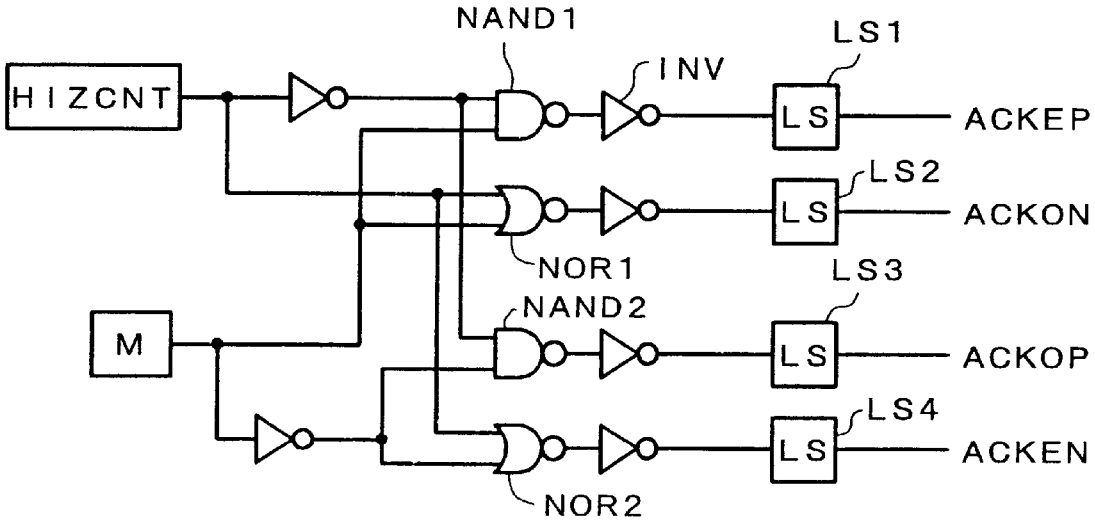
FIG. 14 is a schematic diagram of a circuit for generating control signals (ACKEP, ACKOP, ACKEN, ACKON) shown in FIG. 11.

FIG. 14 shows an example of a circuit for generating the control signals (ACKEP, ACKOP, ACKEN, ACKON) shown in FIG. 11. Further, in FIG. 14, notations LS1 through LS4 designate level shift circuits.

In the circuit shown by FIG. 14, the alternating signal (M) is inputted to an NAND circuit (NAND1) and an NOR circuit (NOR1), and the alternating signal (M), which is inverted by an inverter (INV), is inputted to an NAND circuit (NAND2) and an NOR circuit (NOR2). Further, the NAND circuits (NAND1, NAND2) receive the control signal (HIZCNT) and the NOR circuits (NOR1, NOR2) receive the control signal (HIZCNT) inverted by an inverter (INV).

Table 1 shows a truth table of the NAND circuits (NAND1, NAND2) and the NOR circuits (NOR1, NOR2) and ON/OFF states of the respective transfer gates (TG1 through TG4) at that time. As is apparent from Table 1, when the control signal (HIZCNT) is at the H level, the NAND circuits (NAND1, NAND2) become H level and the NOR circuits (NOR1, NOR2) become L level and the respective transfer gates (TGI through TG4) are brought into an OFF state. Further, as is also apparent from Table 1, when the control signal (HIZCNT) is at the L level, in accordance with the H level or the L level of the alternating signal (M), the respective NAND circuits (NAND1, NAND2) become H level or L level and the respective NOR circuits (NOR1, NOR2) become H level or L level.

TABLE 1

| HIZCNT | M | NOR1 | NAND2 | NAND1 | NOR2 | TG1 | TG2 | TG3 | TG4 |
|---|---|---|---|---|---|---|---|---|---|
| H | * | L | H | H | L | OFF | OFF | OFF | OFF |
| L | H | L | H | L | H | OFF | OFF | ON | ON |
| | L | H | L | H | L | ON | ON | OFF | OFF |

Thereby, the transfer gate (TG1) and the transfer gate (TG2) become OFF or ON and transfer gate (TG3) and the transfer gate (TG4) become ON or OFF.

According to the liquid crystal display device (LCM) of the present embodiment, a voltage range of a grayscale voltage applied to the liquid crystal layer of the respective pixel is 0 through 5 V on the negative polarity side and 5 through 10 V on the positive polarity side; and, accordingly, a grayscale voltage of 0 through 5 V having a negative polarity is outputted from the low voltage amplifier 272 and a grayscale voltage of 5 through 10 V having a positive polarity is outputted from the high voltage amplifier 271. In this case, for example, when the transfer gate (TG1) is OFF and the transfer gate (TG4) is ON, a maximum voltage of 10 V is applied between source and drain of an MOS transistor constituting the transfer gate (TG1). Therefore, high withstand voltage MOS transistors having a withstand voltage of 10 V between source and drain may be used as the MOS transistors constituting the respective transfer gates (TG1 through TG4).

(Modified example of the liquid crystal display device according to the invention)

Figure 15:
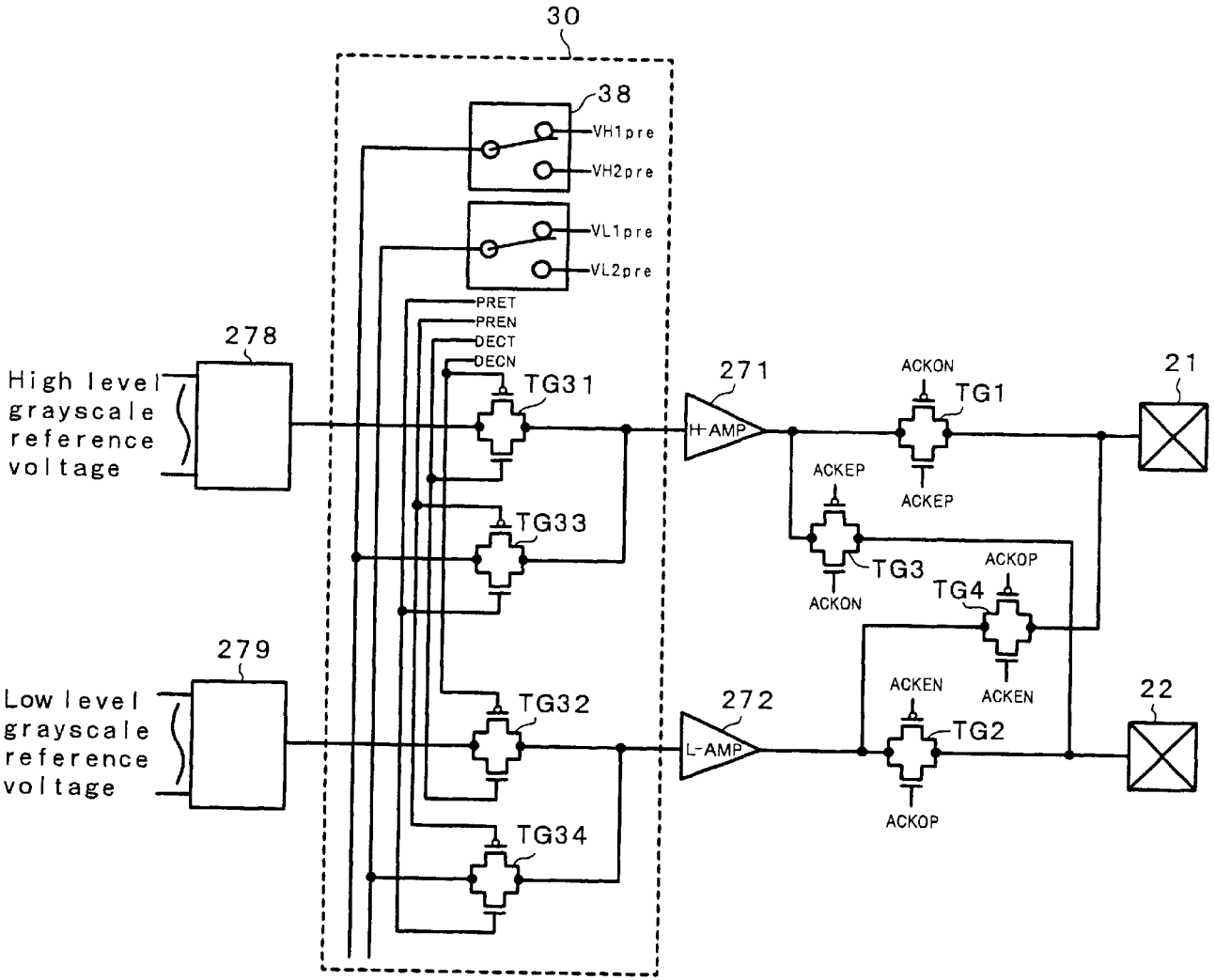
FIG. 15 is a circuit diagram of other example of a liquid crystal display device according to an embodiment of the invention.

FIG. 15 shows another example of a liquid crystal display device according to the invention. FIG. 15 illustrates only the high voltage decoder 278, the low voltage decoder 279, the high voltage amplifier 271 and the low voltage amplifier 272, and only the output route outputting contiguous ones of the drain signals (D) for respective color to, for example, the first one of the drain signal line (Y1) and the fourth one of the drain signal line (Y4).

The liquid crystal display device shown in FIG. 15 is provided with a precharge voltage selecting switch 38, and by the precharge voltage selecting switch 38, a first precharge voltage (VH1pre) for a high voltage or a second precharge voltage (VH2pre) for a high voltage is selected, and the selected voltage is applied to the high voltage amplifier 271 as a precharge voltage for a high voltage in the precharge time period. Similarly, in the low voltage amplifier 272, by the precharge voltage selecting switch 38, a first precharge voltage (VL1pre) for a low voltage or second precharge voltage (VL2pre) for a low voltage is selected, and the selected voltage is applied to the low voltage amplifier 272 as a precharge voltage for a low voltage in the precharge time period.

(Voltage value of precharge voltage according to the embodiment)

According to the embodiment, the precharge voltage (VHpre) for a high voltage supplied to the high voltage amplifier 271 may be any of sixty-four grayscale levels of grayscale voltages having a positive polarity, and a precharge voltage (VLpre) for a low voltage supplied to the low voltage amplifier 272 may be any of sixty-four grayscale levels of grayscale voltages having a negative polarity.

Further, according to the embodiment, the precharge voltage (VHpre) supplied to the high voltage amplifier 271 may be any of five values of grayscale reference voltages (V"0 through V"4) having positive polarity supplied from the positive voltage generating circuit 121 shown in FIG. 1, and the precharge voltage (VLpre) for a low voltage supplied to the low voltage amplifier 272 may be any of five values of a grayscale reference voltage (V"5 through V"9) having a negative polarity supplied from the negative voltage generating circuit 122.

However, it is most preferable that the precharge voltage (VHpre) for the high voltage supplied to the high voltage amplifier 271 is a voltage deviated to a maximum grayscale voltage more than an intermediate voltage (hereinafter, referred to as an intermediate voltage having a positive polarity) between a maximum prescale voltage having the largest potential difference relative to drive the voltage (opposed voltage) applied to the common electrode and a minimum grayscale voltage having the smallest potential difference relative to the drive voltage applied to the common electrode among sixty-four grayscale levels of grayscale voltages having a positive polarity. It is most preferable that the precharge voltage (VLpre) for a low voltage supplied to the low voltage amplifier 272 is a voltage deviated to the maximum grayscale voltage more than the intermediate voltage (hereinafter, referred to as an intermediate voltage having a negative polarity) between the maximum grayscale voltage having the largest potential difference relative to the drive voltage applied to the common electrode and the minimum grayscale voltage having the smallest potential difference relative to the drive voltage applied to the common electrode among sixty-four grayscale levels of grayscale voltages having a negative polarity.

Figure 16B:
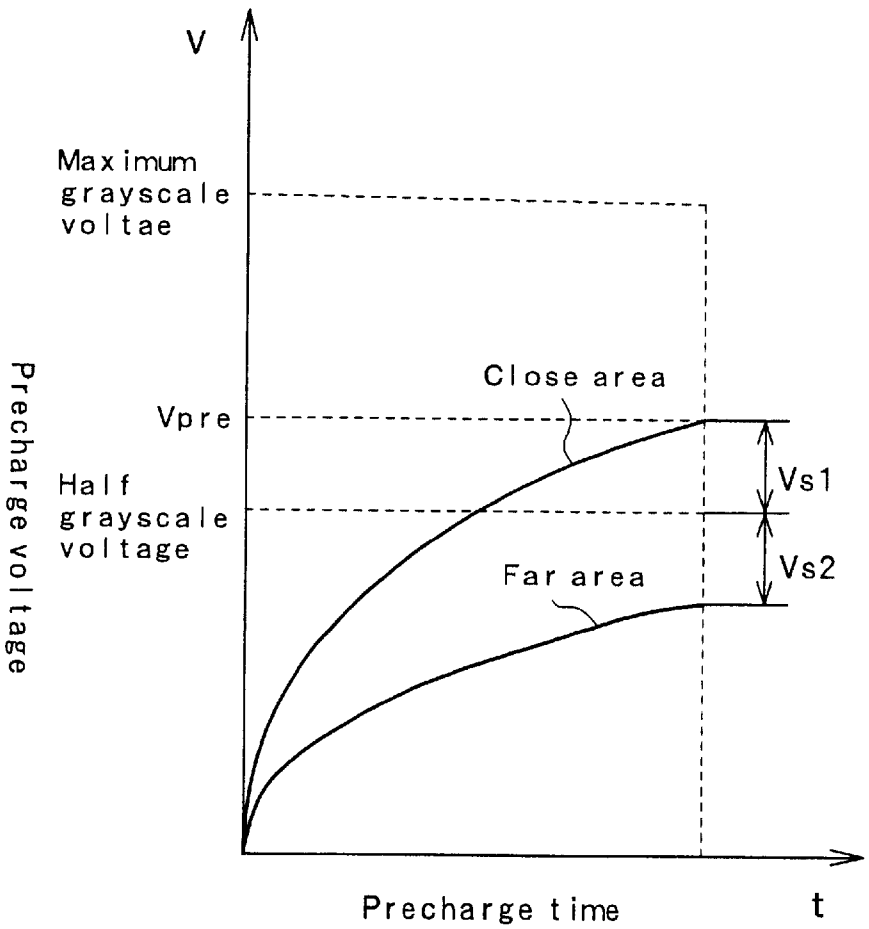
FIG. 16*a* and FIG. 16*b* are graphs illustrating a potential variation in a precharge period at an area of a single piece of drain signal line (D) close to a drain driver and an area thereof farthest from the drain driver.
Figure 16A:
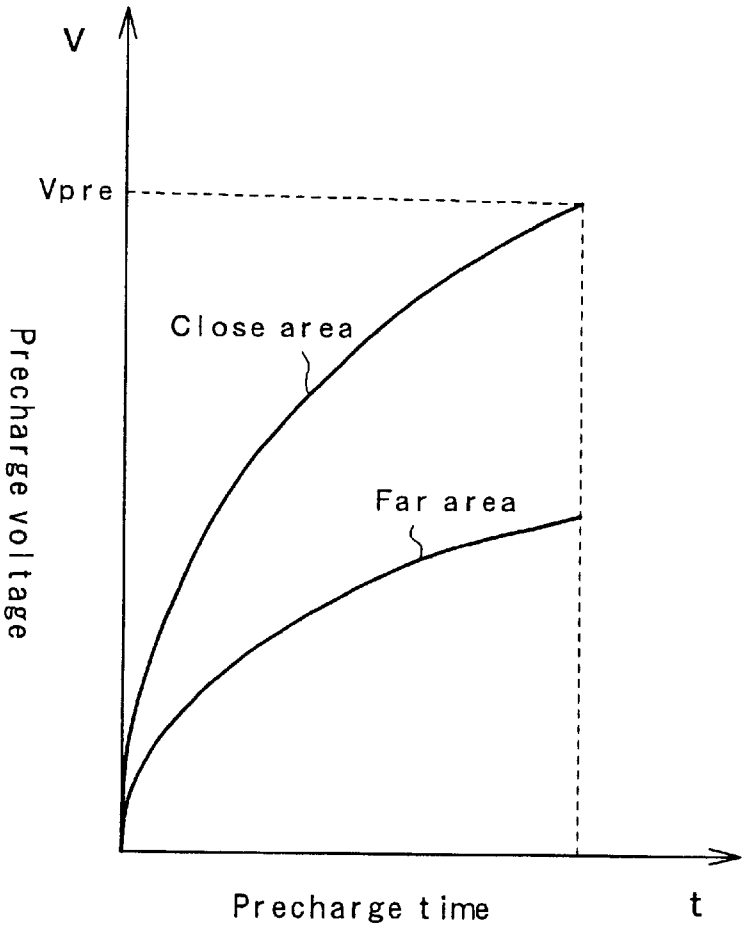

FIG. 16*a* shows the potential variation during the precharge time period at a portion of a single drain signal line (D) close to the drain driver 130 and at a portion thereof farthest from the drain driver 130. As is apparent from FIG. 16*a,* even when the precharge voltage, for example, the precharge voltage (VHpre) for the high voltage is applied to the single drain signal line (D) or the precharge voltage (VLpre) for the low voltage is applied thereto during the precharge time period, the potential variation differs between the portion close to the drain driver 130 and the portion farthest from the drain driver 130.

Generally, as the precharge voltage (VHpre) for the high voltage, an intermediate voltage having a positive polarity is preferable. However, when the intermediate voltage having a positive polarity is selected as the precharge voltage (VHpre) for the high voltage, as shown by FIG. 16*a,* the intermediate voltage having a positive polarity is not constituted at the portion farthest from the drain driver 130. Therefore, as shown by FIG. 16*b,* the precharge voltage (VHpre) for the high voltage is most preferably a voltage deviated to the maximum grayscale voltage by more than the intermediate voltage having the positive polarity, and a voltage in which absolute values of a potential difference (Vs1) between the precharge voltage at the portion close to the drain driver 130 and the intermediate voltage having the positive polarity and a potential difference (Vs2) between the precharge voltage at the portion farthest from drain driver 130 and the intermediate voltage having the positive polarity are equal to each other (Vs1=Vs2).

Similarly, as the precharge voltage (VLpre) for low voltage, a voltage deviated to the maximum grayscale voltage by more than an intermediate voltage having a negative polarity is most preferable.

(Characteristic constitution of amplifier according to the embodiment)

Figure 17:
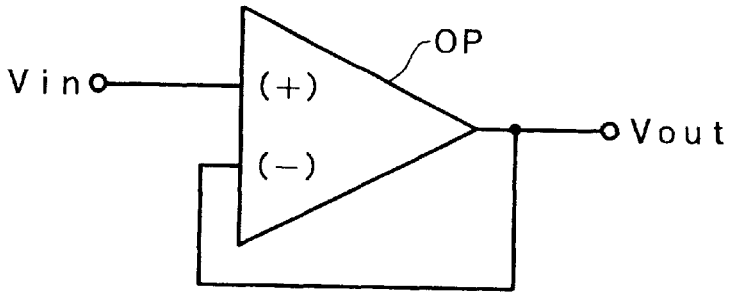
FIG. 17 is a circuit diagram showing a voltage follower circuit used as an amplifier for high voltage and an amplifier for low voltage shown in FIG. 6.

Conventionally, the high voltage amplifier 271 and the low voltage amplifier 272 are constituted by voltage follower circuits in each of which, for example, as shown by FIG. 17, an inverted input terminal (−) and an output terminal of an operational amplifier (OP) are directly connected, and a noninverted input terminal (+) thereof constitutes an input terminal of the amplifier. Further, an operational amplifier (OP) used in the low voltage amplifier 272 is constituted by, for example, a differential amplifier shown in FIG. 18, and an operational amplifier (OP) used in the high voltage amplifier 271 is constituted by a differential amplifier shown, for example, in FIG. 19. However, generally, the operational amplifiers (OP) are provided with an offset voltage (Voff).

Figure 18:
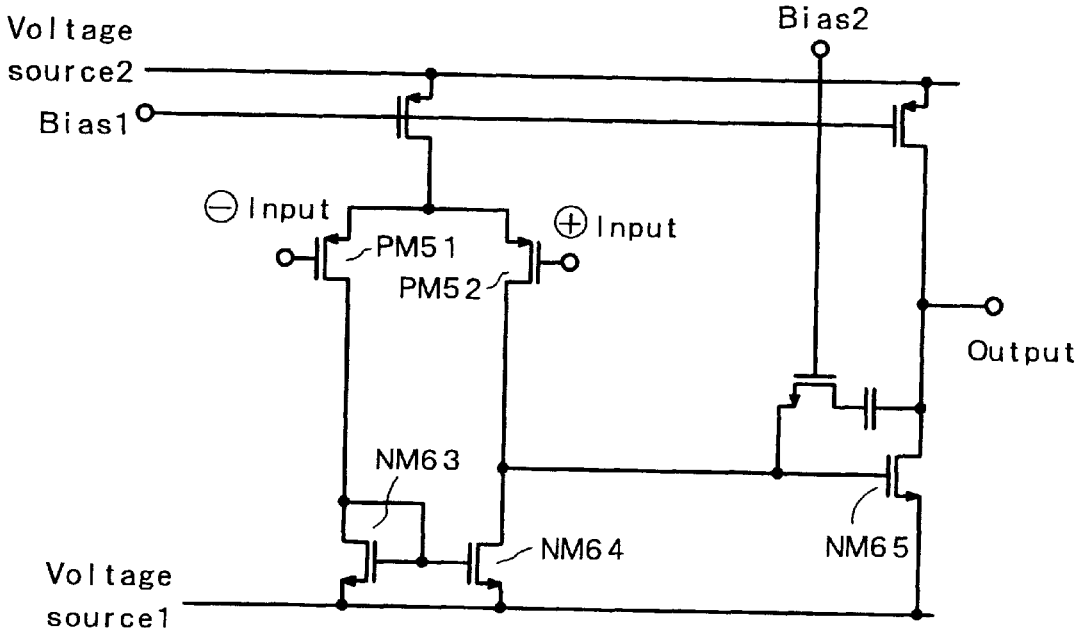
FIG. 18 is a circuit diagram showing an example of a differential amplifier constituting an operational amplifier used in the amplifier for low voltage shown in FIG. 6.
Figure 19:
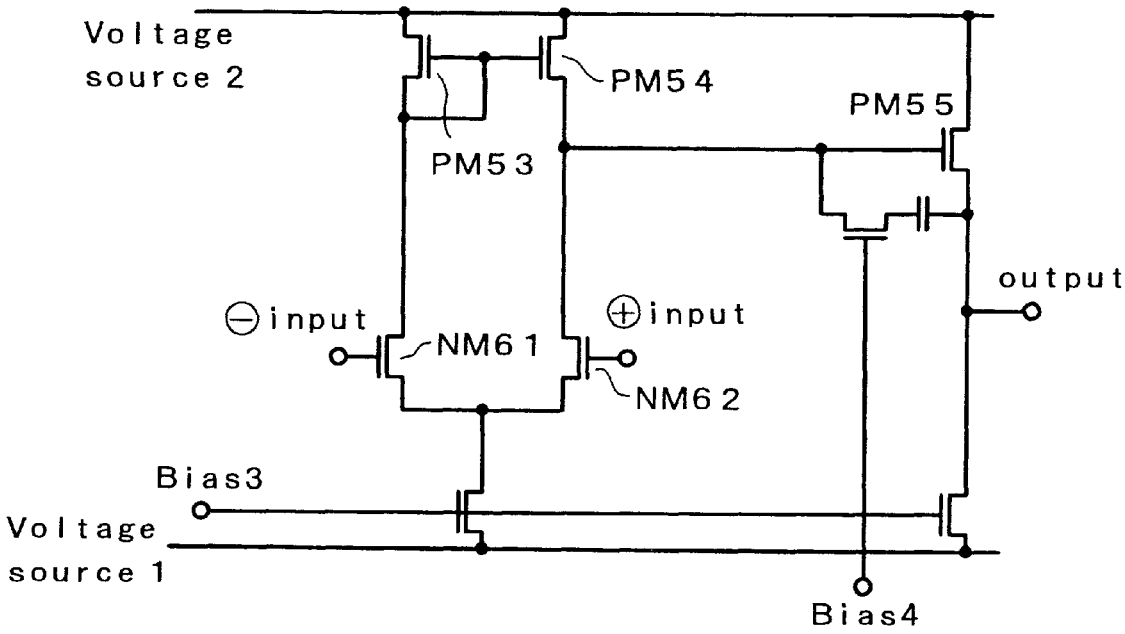
FIG. 19 is a circuit diagram showing an example of a differential amplifier constituting an operational amplifier used in the amplifier for high voltage shown in FIG. 6.

When a basic operational amplifier (OP) is constituted by the differential amplifier shown in FIG. 18 or FIG. 19, the offset voltage (Voff) is generated owing to a delicate imbalance of symmetry between the PMOS transistors (PM51, PM52) or NMOS transistors (NM61, NM62) at an input stage or NMOS transistors (NM63, NM64) or PMOS transistors (PM53, PM54) constituting an active load circuit in the differential amplifier shown in FIG. 18 or FIG. 19. The delicate imbalance of symmetry is caused by a change in threshold voltage (Vth) of a MOS transistor or a change in gate width/gate length (W/L) of a MOS transistor by a dispersion in ion implantation/ion injection process or photolithography process in the fabrication process, and it is impossible to nullify the offset voltage (Voff) even under strict process control.

Figure 20:
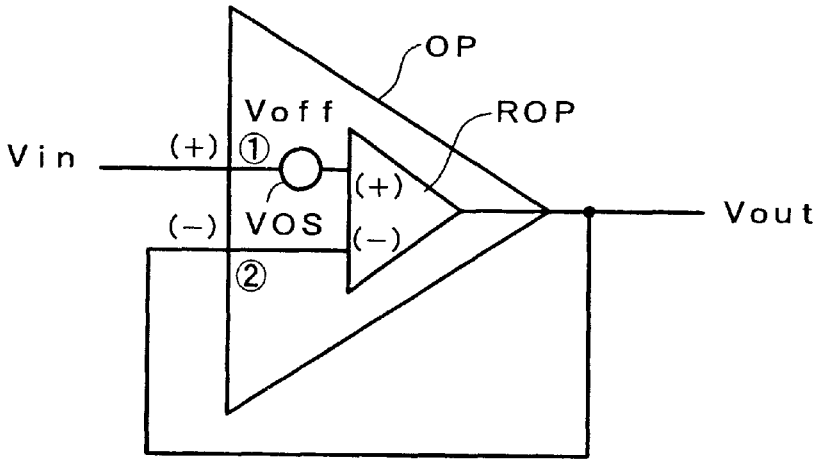
FIG. 20 is an equivalent circuit diagram of an operational amplifier in consideration of offset voltage (Voff)

As shown in FIG. 20, when the operational amplifier (OP) is an ideal operational amplifier having no offset voltage (Voff), the input voltage (Vin) is equal to the output voltage (Vout) (Vin=Vout); whereas, when the operational amplifier (OP) is provided with the offset voltage (Voff), the input voltage (Vin) is not equal to the output voltage (Vout), and the output voltage (Vout) is the input voltage (Vin) added to the offset voltage (Voff) (Vout=Vin+Voff). Further, FIG. 20 shows an equivalent circuit of the operational amplifier in consideration of the offset voltage (Voff); and, in FIG. 20, notation ROP designates the ideal operational amplifier not having an offset voltage (Voff), and notation VOS designates a voltage source the voltage value of which is equal to that of the offset voltage (Voff).

In the conventional liquid crystal display device using the voltage follower circuits shown in FIG. 17 as the high voltage amplifier (271 shown in FIG. 6) and the low voltage amplifier (272 shown in FIG. 6) of the output circuit (157 shown in FIG. 5) of the drain driver, the input voltage and the output voltage of the voltage follower circuit do not coincide with each other, and the liquid crystal drive voltage outputted from the voltage follower circuit to the drain signal line (D) is a grayscale voltage inputted to the voltage follower circuit added to the offset voltage of the operational amplifier. Thereby, according to the conventional liquid crystal display device, this poses a problem in that a black or white vertical streak is caused on a display screen displayed on a liquid crystal display panel, with the result that the display quality is significantly deteriorated.

Figure 21:
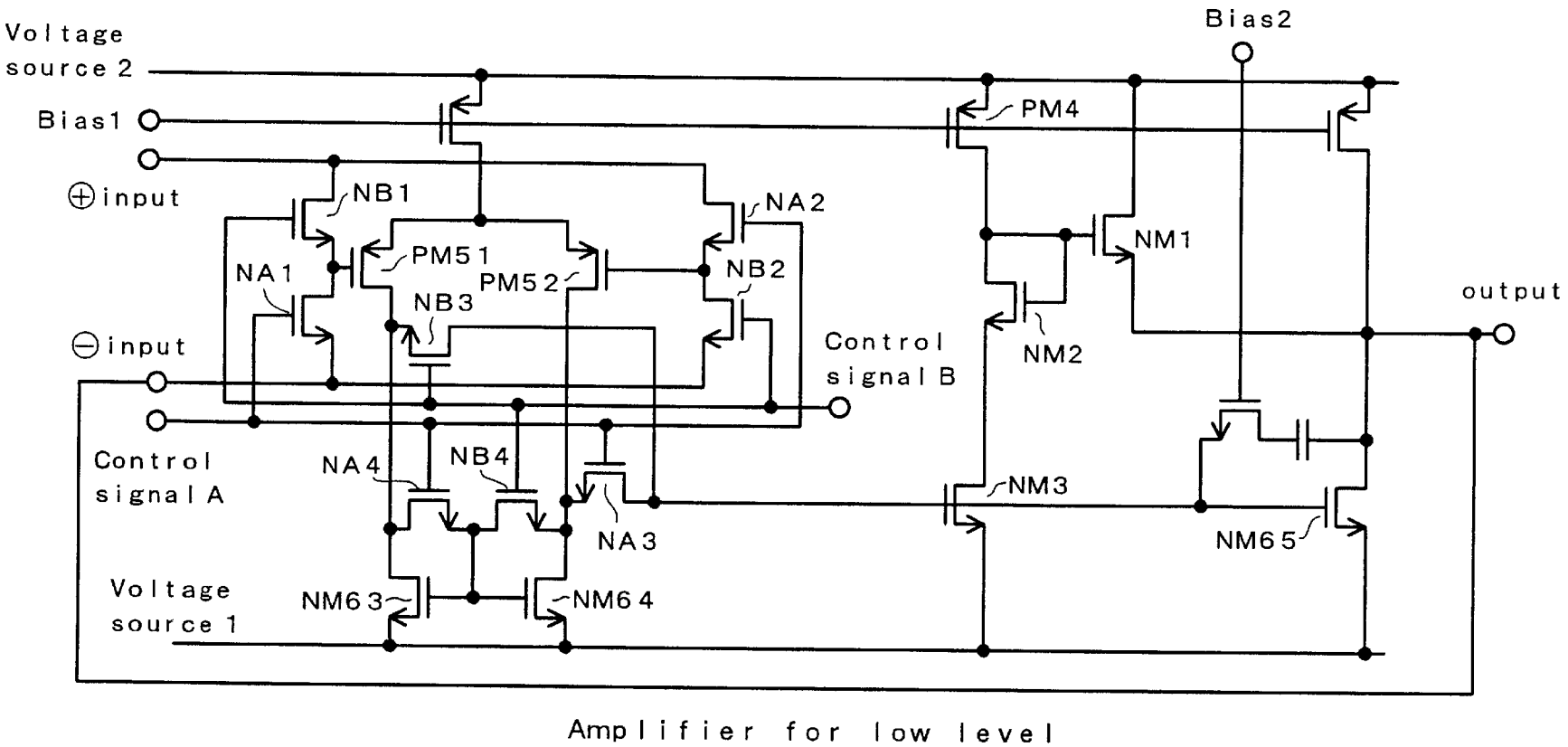
FIG. 21 is a circuit diagram showing a circuit diagram constitution of an amplifier for low voltage according to Embodiment 1.
Figure 22:
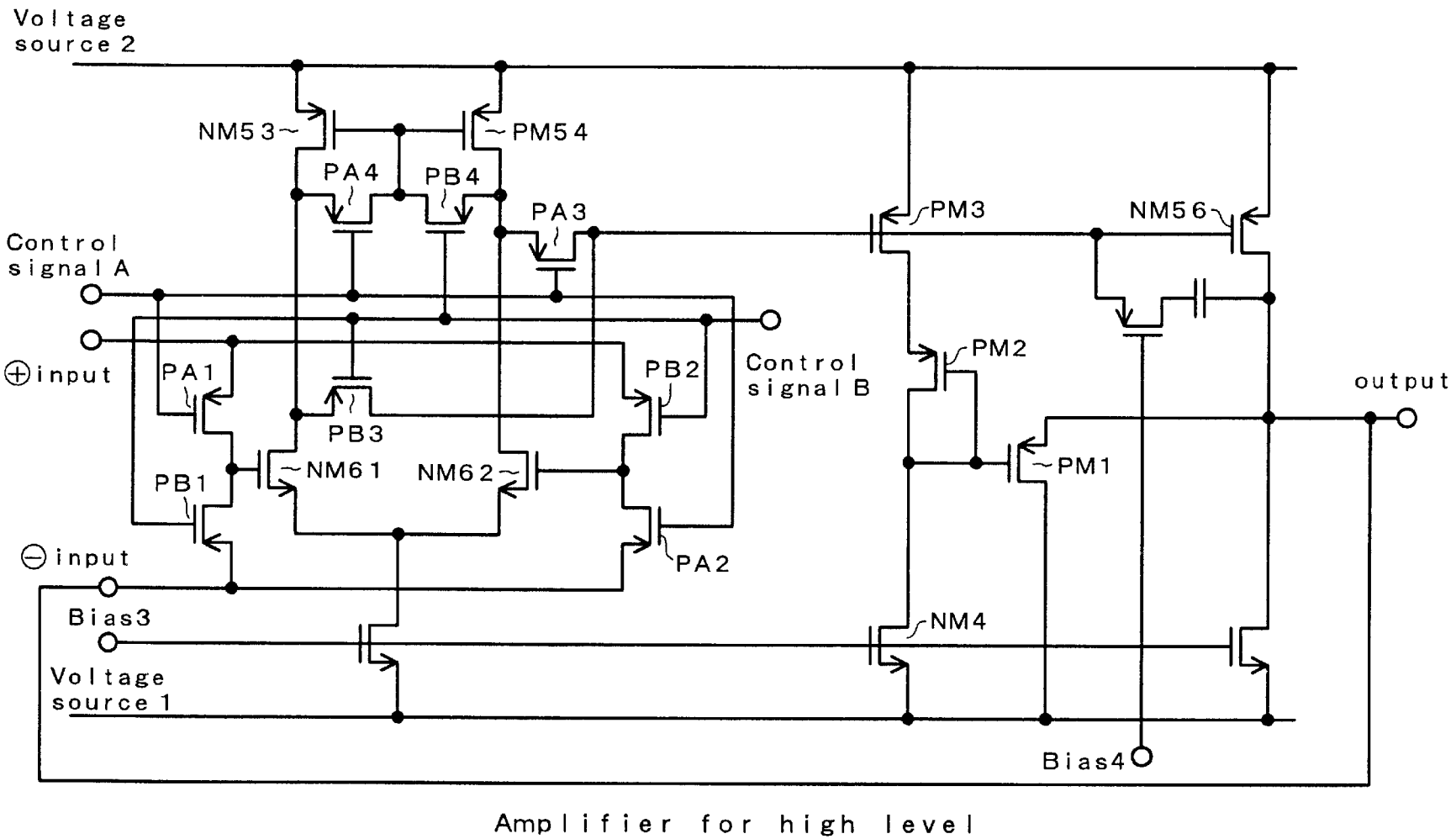
FIG. 22 is a circuit diagram showing a circuit constitution of an amplifier for high voltage according to Embodiment 1.

FIG. 21 is a circuit diagram of the low voltage amplifier 272 in the drain driver 130 according to the embodiment. FIG. 22 is a circuit diagram of the high voltage amplifier 271 in the drain driver 130 according to the embodiment.

The low voltage amplifier 272 according to the embodiment shown in FIG. 21 differs from the differential amplifier shown in FIG. 18 in the following points.

(1) The differential amplifier shown in FIG. 18 additionally includes switching transistors (NA1, NB1) for connecting a gate electrode (control electrode) of the PMOS transistor (PM51) at the input stage to the (+) input terminal or (−) input terminal, switching transistors (NA2, NB2) for connecting a gate electrode of the PMOS transistor (PM52) of the input stage to the (+) input terminal or (−) input terminal, switching transistors (NA3, NB3) for connecting a gate electrode of an NMOS transistor at an output stage to a drain electrode (second electrode) of the PMOS transistor (PM51) at the input stage or a drain electrode of the PMOS transistor (PM52) at the input stage and the switching transistors (NA4, NB4) for connecting gate electrodes of the NMOS transistors (NM63, NM64) constituting the active load circuit to the drain electrode of the PMOS transistor (PM51) at the input stage or the drain electrode of the PMOS transistor (PM52) at the input stage.

(2) An NMOS transistor (NM1) is connected between an output terminal, a power source 2 and a series circuit consisting of a PMOS transistor (PM4), an NMOS transistor (NM2) and an NMOS transistor (NM3) for controlling a gate electrode of the NMOS transistor (NM1).

The NMOS transistor (NM1) is turned ON when the voltage of the output terminal (voltage of drain signal line (D)) is lower than the voltage applied to the (+) input terminal of the differential amplifier and elevates the voltage of the drain signal line (D) by providing a current flow to the drain signal line (D) (realize so-to-speak an off buffer function).

The high voltage amplifier 271 according to the embodiment shown in FIG. 22 differs from the differential amplifier shown in FIG. 19 in the following points.

(1) Similar to the low voltage amplifier 272 shown in FIG. 21, the differential amplifier shown in FIG. 19 additionally includes switching transistors (PA1 through PA4, PB1 through PB4).

(2) A PMOS transistor (PM1) is connected between an output terminal, a power source 1 and a series circuit consisting of a PMOS transistor (PM3), a PMOS transistor (PM2) and an NMOS transistor (NM4) for controlling a gate electrode of the PMOS transistor (PM1).

The NMOS transistor (NM4) is turned ON when the voltage of the output terminal (voltage of the drain signal line (D)) is higher than the voltage applied to the (+) input terminal of the differential amplifier, and draws current from the drain signal line (D) so as to reduce the voltage of the drain signal line (realize so-to-speak an off buffer function). In this case, gate electrodes of the switching transistors, (NA1 through NA4, PA1 through PA4) are supplied with a control signal (A) and gate electrodes of the switching transistors (NB1 through NB4, PB1 through PB4) are supplied with a control signal (B).

Figure 23:
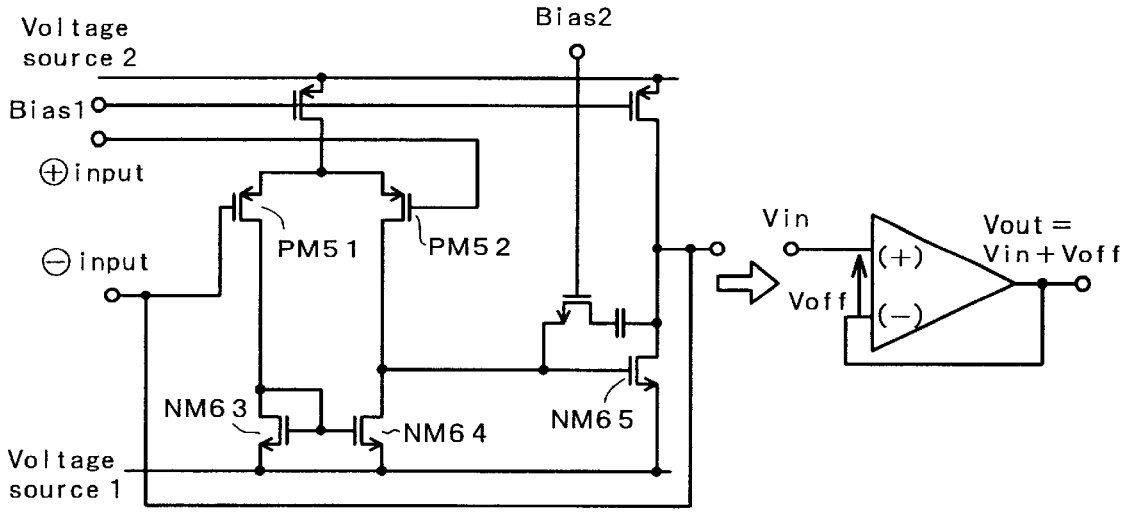
FIG. 23 is a circuit diagram showing a circuit in the case in which a control signal (A) is at H level in the amplifier for low voltage according to Embodiment 1.
Figure 24:
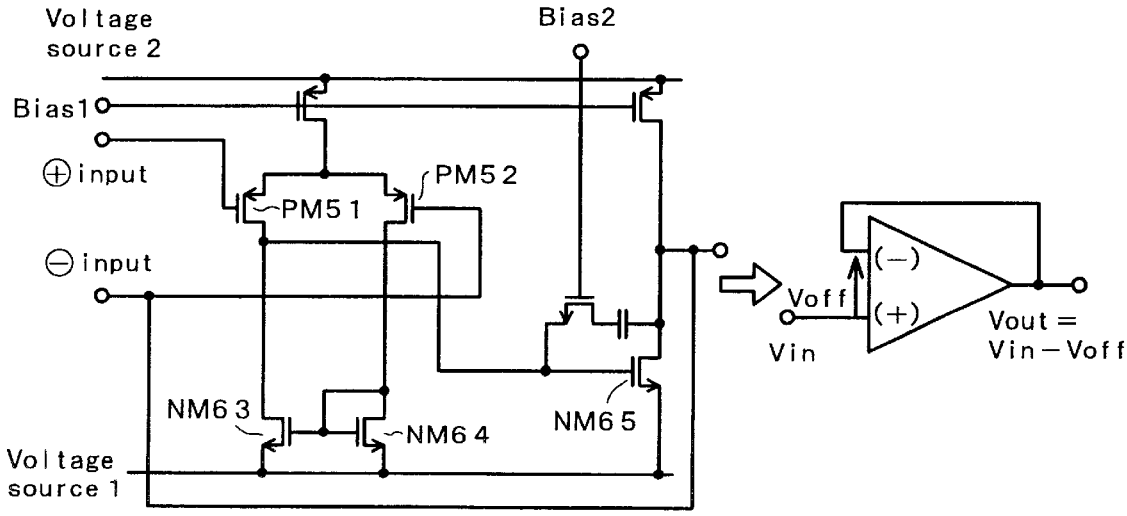
FIG. 24 is a circuit diagram showing a circuit in the case in which a control signal (B) is at H level in the amplifier for low voltage according to Embodiment 1.

In the low voltage amplifier 272, according to the embodiment shown in FIG. 21, the circuit constitution in the case in which the control signal (A) is at the H level and the control signal (B) is at the L level is shown in FIG. 23, and the circuit constitution in the case in which the control signal (A) is at the L level and the control signal (B) is at the H level is shown in FIG. 24. Further, FIG. 23 and FIG. 24 also illustrate with circuit constitutions in the case in which the amplifiers in FIG. 23 and FIG. 24 are expressed by using general operational amplifier signs. In FIG. 23 and FIG. 24, the NMOS transistor (NM1) and the series circuit of the PMOS transistor (PM1), the NMOS transistor (NM2) and the NMOS transistor (NM3) for controlling the gate electrode of the NMOS transistor (NM1), which realizes the OFF buffer function, are omitted.

As can be understood from FIG. 23 and FIG. 24, according to the low voltage amplifier 272 of the embodiment, the MOS transistor at the input stage supplied with the input voltage (Vin) and the MOS transistor at the input stage fed back with the output voltage (Vout) are alternately switched. Thereby, according to the circuit constitution of FIG. 23, as shown by Equation (1), shown below, the output voltage (Vout) is the input voltage (Vin) added to the offset voltage (Voff).

$$Vout = Vin + Voff \quad \text{(1) (Equation 1)}$$

Further, according to the circuit constitution of FIG. 24, as shown by Equation (2), shown below, the output voltage (Vout) is the input voltage (Vin) from which the offset voltage (Voff) is subtracted.

$$Vout = Vin - Voff \quad \text{(2) (Equation 2)}$$

Figure 25:
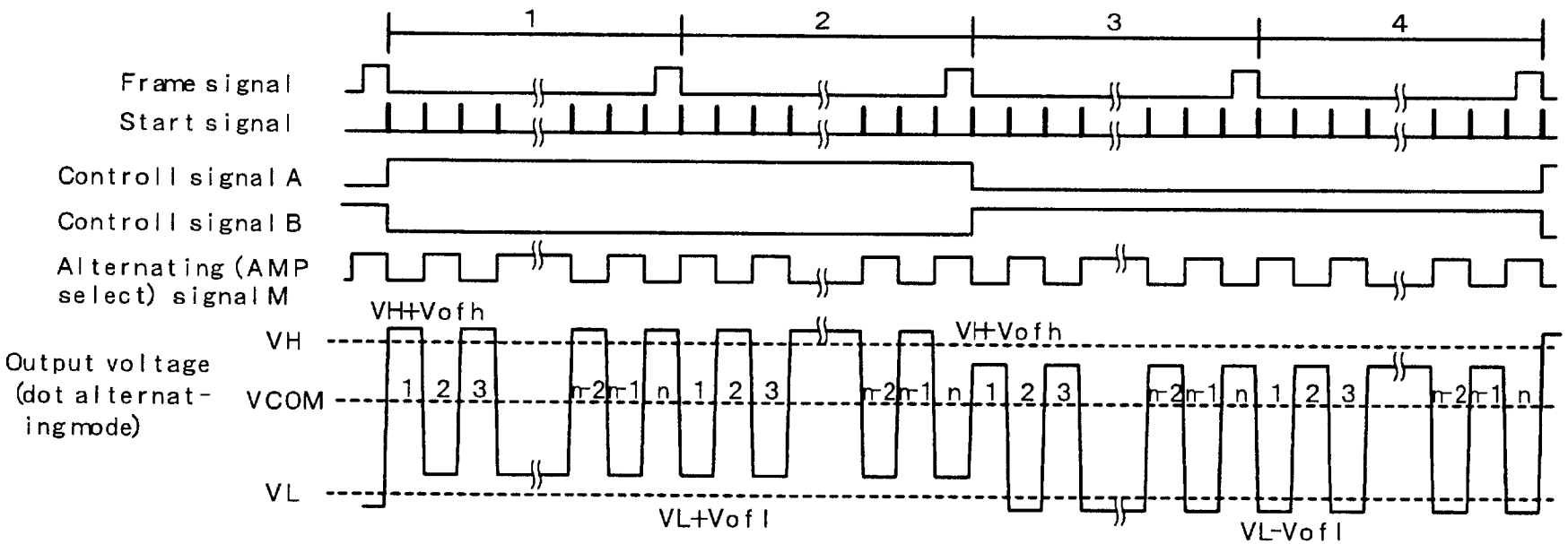
FIG. 25 is a timing chart illustrating operation of a drain driver according to Embodiment 1.

Output voltages shown in FIG. 25 indicate output voltages outputted from the high voltage amplifier 2711 and the low voltage amplifier 272 to the drain signal lines (D) connected to the high voltage amplifier 271, having an offset voltage of Vofh, and the low voltage amplifier 272, having offset voltage of Vofl. With regard to these output voltages, notation VH designates a regular grayscale voltage outputted from the high voltage amplifier 271 when the high voltage amplifier 271 is not provided with the offset voltage, and notation VL designates a regular grayscale voltage outputted from the low voltage amplifier 272 when the low voltage amplifier 272 is not provided with the offset voltage.

As shown by the time chart of FIG. 25, the phases of the control signal (A) and the control signal (B) are inverted at every 2 frames. Therefore, as shown by FIG. 25, the drain signal line (D), connected with the high voltage amplifier 271 having the offset voltage of Vofh and the low voltage amplifier 272 having the offset voltage of Vofl, receives voltage of (VH+Vofh) from the high voltage amplifier 271 at a first line of a first frame, however, a voltage of (VH−VOfh) is outputted from the high voltage amplifier 271 at a first line of a third frame and accordingly, an increase and a decrease in the brightness caused by the offset voltage (Vofh) of the high voltage amplifier 271 are canceled by each other at the corresponding pixel. Further, at a first line of a second frame, a voltage of (VL+Vof) is outputted from the low voltage amplifier 272, however, at a first line of a fourth frame, a voltage of (VL−Vofl) is outputted from the low voltage amplifier 272, and, accordingly, an increase and a decrease in the brightness caused by the offset voltage (Vofl) of the low voltage amplifier 272 are canceled by each other at the corresponding pixel.

Figure 26:
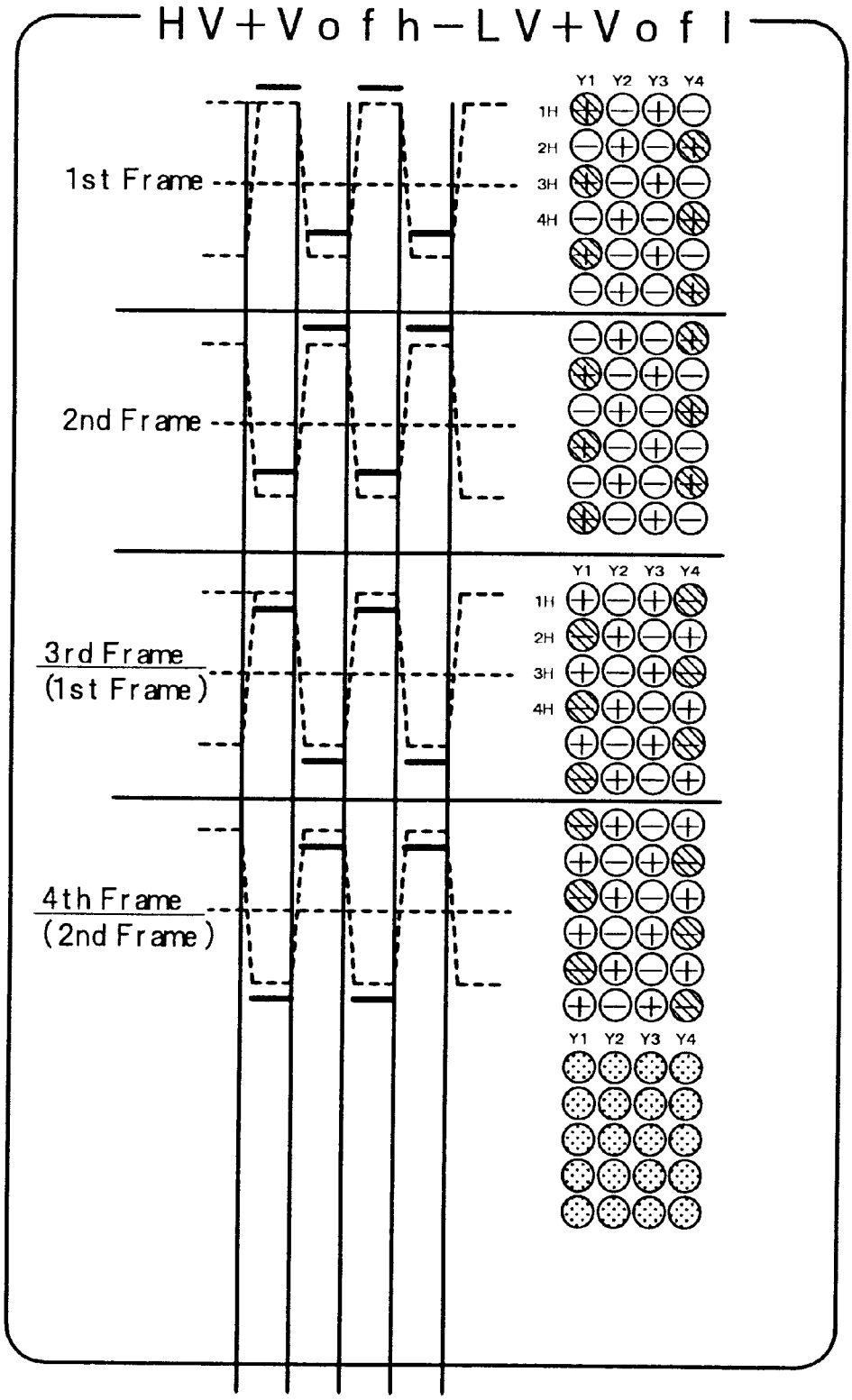
FIG. 26 is a diagram illustrating a reason for making inconspicuous a vertical line produced in a liquid crystal display panel by the offset voltage (Voff) in Embodiment 1.

Thereby, as shown by FIG. 26, an increase and a decrease in the brightness caused by the offset voltages (Vofh, Vofl) of the high voltage amplifier 271 and the low voltage amplifier 272 are canceled by each other every consecutive 4 frames, and, accordingly, the brightness of the pixel supplied with the output voltage indicated by FIG. 25 becomes normal brightness in correspondence with the grayscale voltage. Further, although according to the time chart shown in FIG. 25, the phases of the control signal (A) and the control signal (B) are inverted every 2 frames, the phases of the control signal (A) and the control signal (B) may be inverted every 2 lines in each frame and every 2 frames. The brightness of the pixel in this case is shown by FIG. 27 and FIG. 28.

Figure 27:
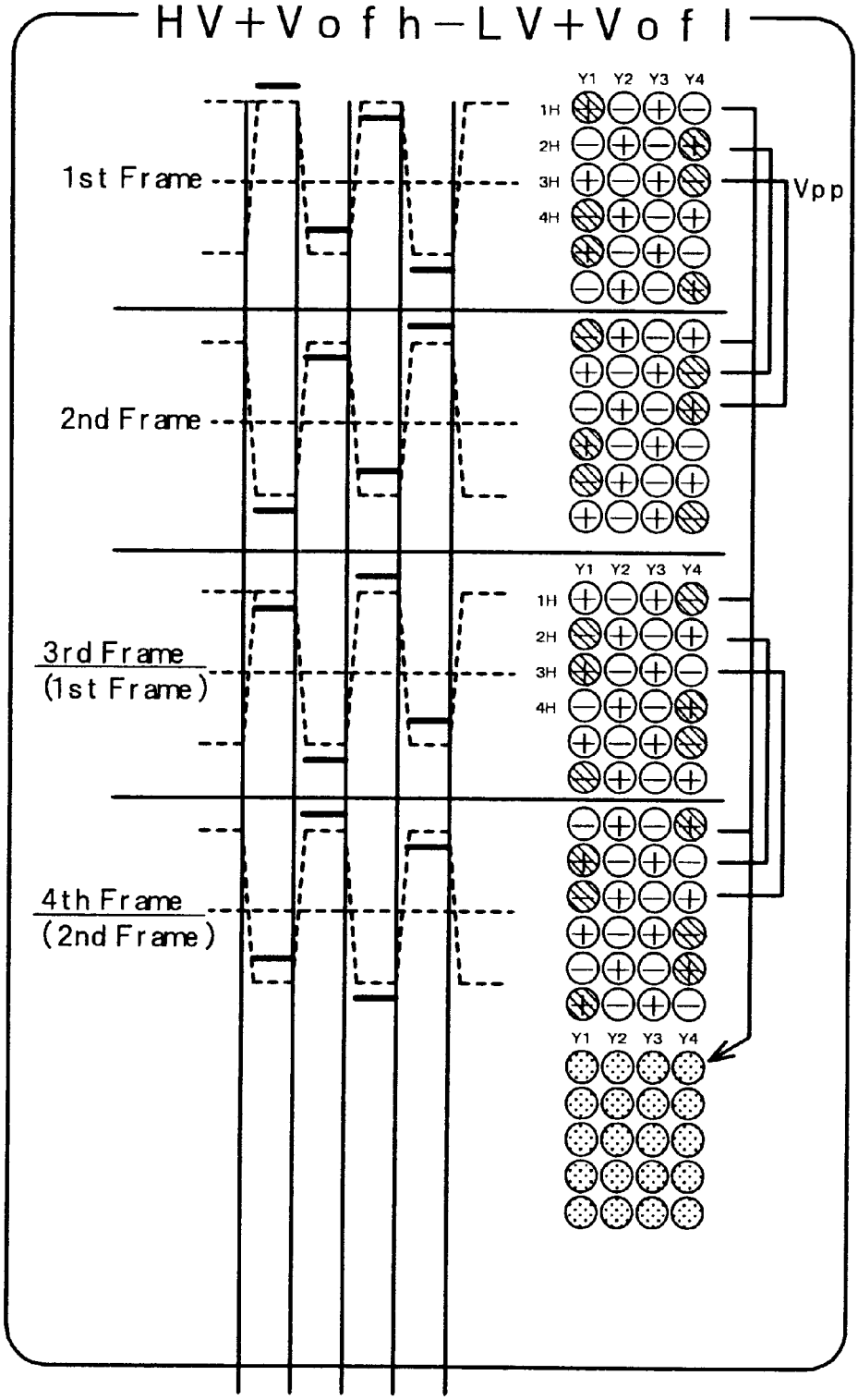
FIG. 27 is a diagram illustrating a reason for making inconspicuous a vertical line produced in a liquid crystal display panel by the offset voltage (Voff) in Embodiment 1.

FIG. 27 shows a case in which, when the control signal (A) is at the H level, the high voltage amplifier 271 is provided with the (+) offset voltage (Vofh) and the low voltage amplifier 272 is provided with the (+) offset voltage (Vofl). Further, FIG. 28 shows a case in which, when the control signal (A) is at the H level, the high voltage amplifier 271 is provided with the (+) offset voltage (Vofh) and the low voltage amplifier 272 is provided with the (−) offset voltage (Vofl). In either of the cases, an increase and a decrease in the brightness caused by the offset voltages (Vofh, Vofl) of the high voltage amplifier 271 and the low voltage amplifier 272 are canceled by each other every consecutive 4 frames, and, accordingly, the brightness of the pixel becomes normal brightness in correspondence with grayscale voltage. However, by inverting the phases of the control signal (A) and the control signal (B) every 2 lines in each frame, as shown by FIG. 27 and FIG. 28, the brightness of the pixels in a column direction are changed as black→4 white (or white→black) every 2 lines, and, accordingly, a vertical streak becomes more inconspicuous in the display screen displayed on the liquid crystal display panel 10.

Figure 28:
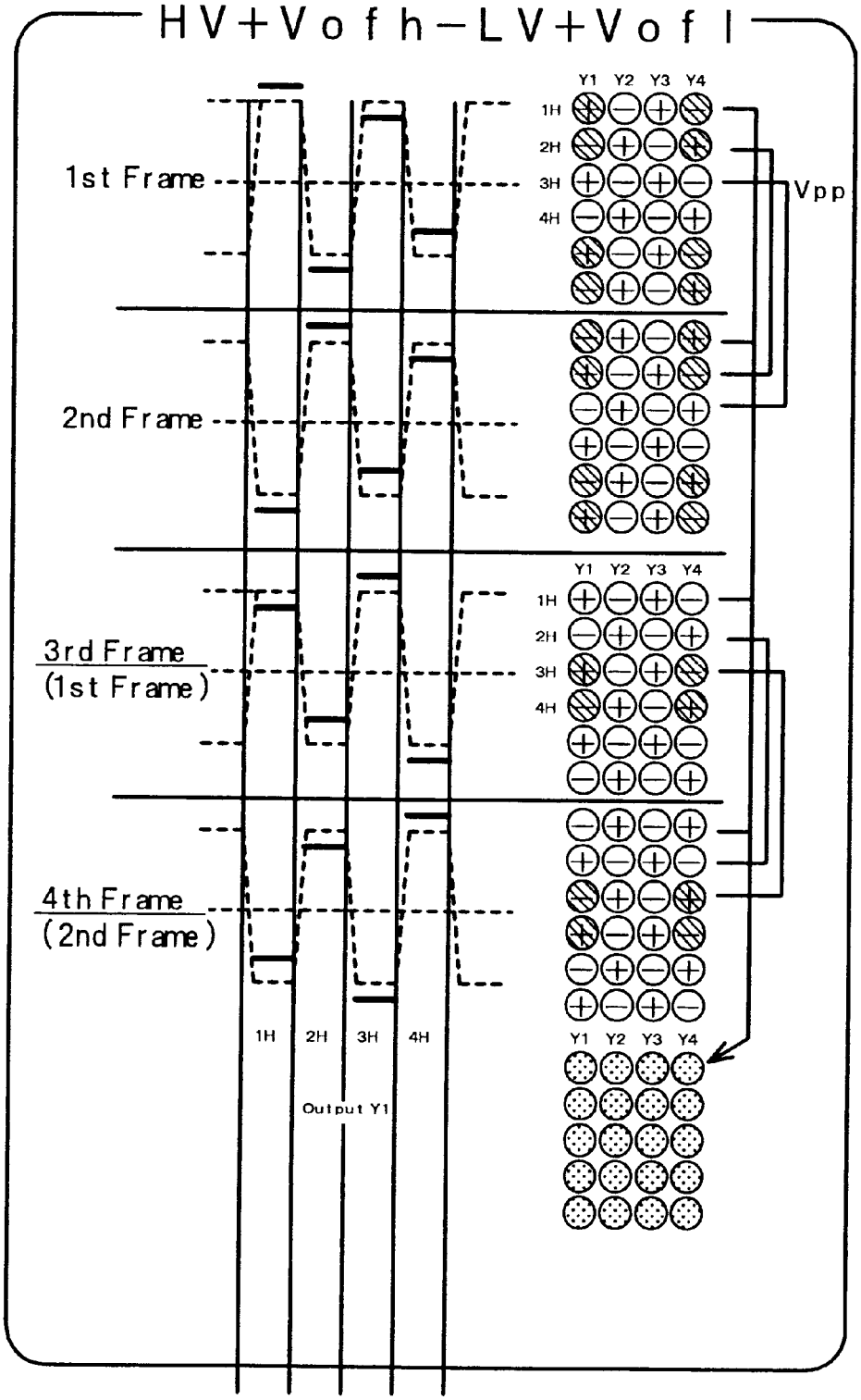
FIG. 28 is a diagram illustrating a reason for making inconspicuous a vertical line produced in a liquid crystal display panel by the offset voltage (Voff) in Embodiment 1.

Further, although in FIG. 27 or FIG. 28, the phases of the control signal (A) and the control signal (B) are inverted every 2 lines in one frame to thereby change the brightness of the pixels in the column direction, to thereby make the vertical streak inconspicuous, the phases need not be inverted every 2 lines. Also, it is preferable that the control signal (A) and the control signal (B) are switched at timings within the precharge time period to thereby prevent outputs of the respective amplifiers (271, 272) under the unstable state from being outputted to the respective drain signal lines (D).

(Method of generating control signal (A) and control signal (B) according to the embodiment)

An explanation will be given of a method of generating the control signal (A) and the control signal (B) according to the embodiment.

Figure 29:
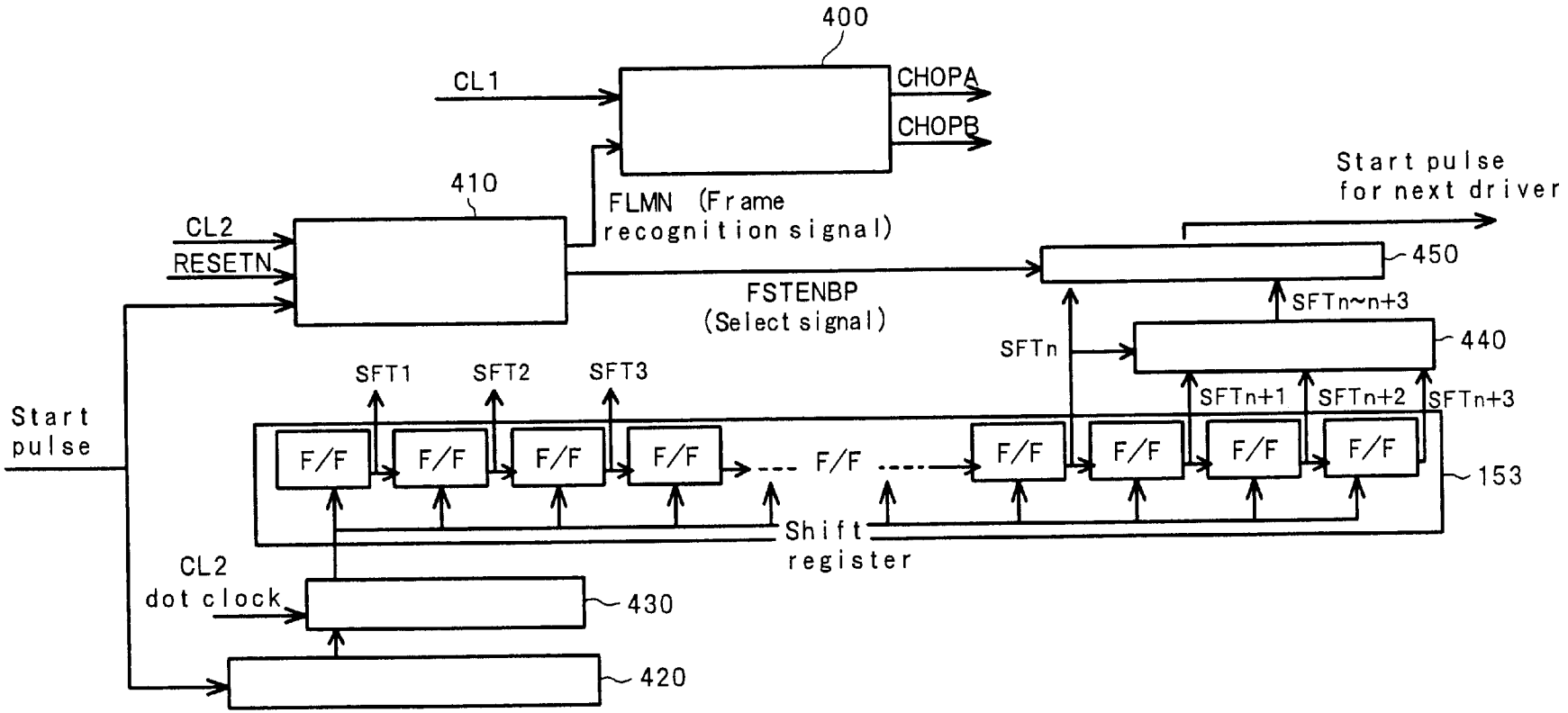
FIG. 29 is a block diagram showing a circuit constitution of essential portions of a control circuit of the drain driver according to Embodiment 1.

FIG. 29 is a block diagram showing essential portions in the control logic unit 152 of the drain driver 130 according to the embodiment. As shown in the drawing, in the control logic unit 152 of the drain driver 130, there are provided the shift register 153, a control signal generating circuit 400, a frame recognizing signal generating circuit 410, a shift clock enable signal generating circuit 420, a shift clock generating circuit 430, a pulse generating circuit 440 and a pulse selecting circuit 450.

Figure 30:
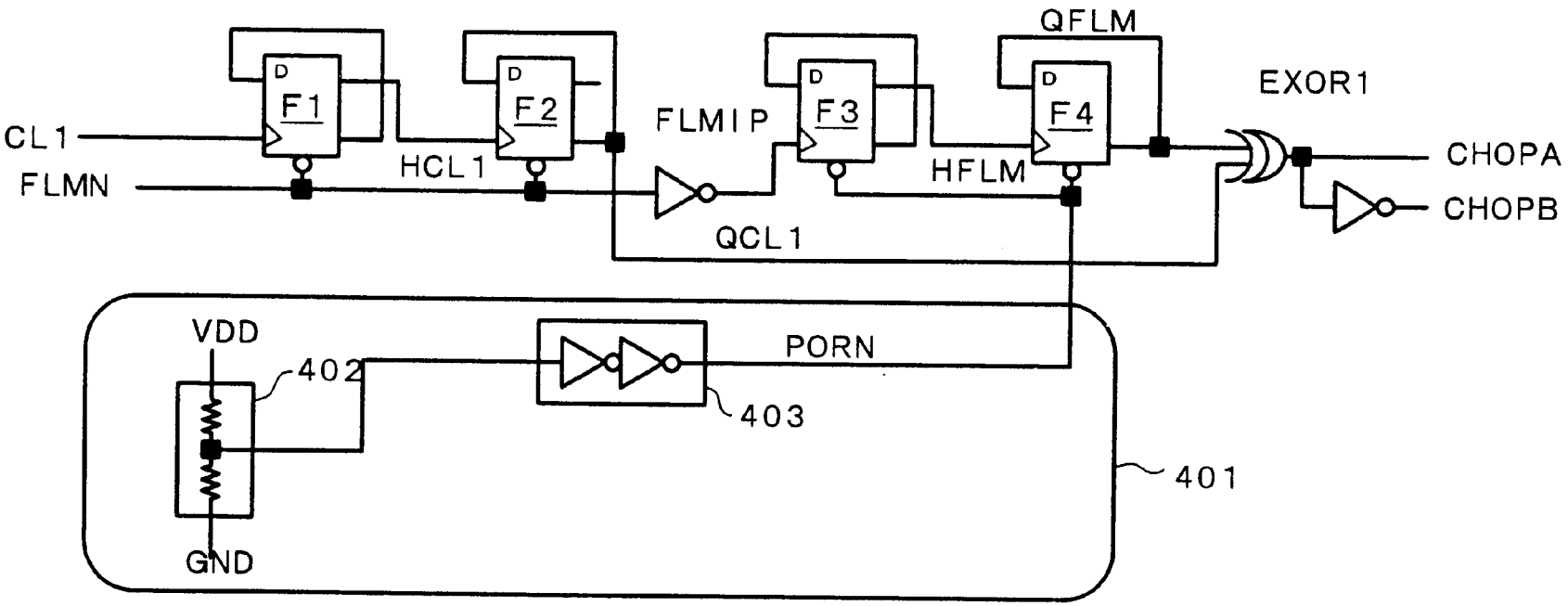
FIG. 30 is a circuit diagram showing a circuit constitution of a control signal generating circuit shown in FIG. 29.
Figure 31:
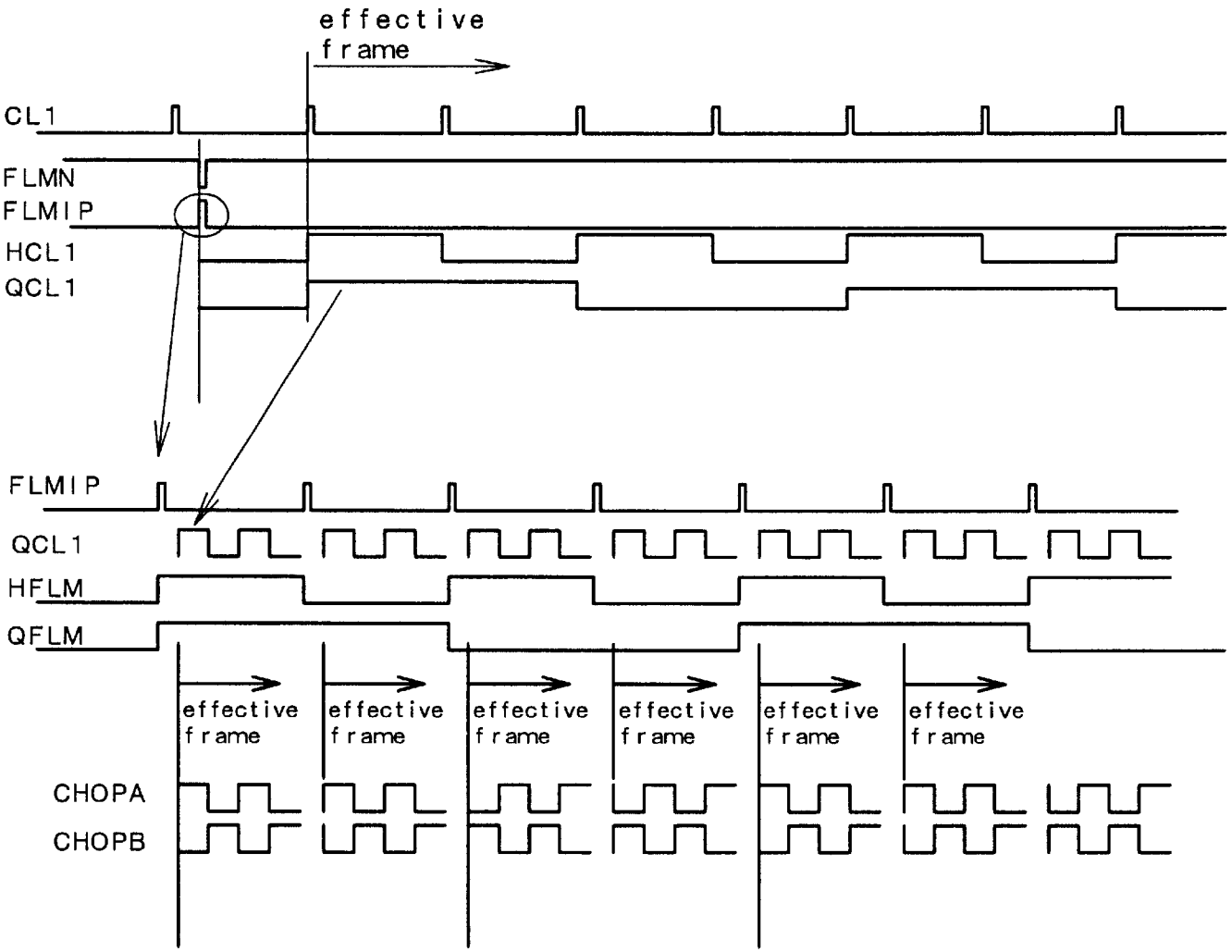
FIG. 31 is a timing chart illustrating the operation of the control signal generating circuit shown in FIG. 30.

FIG. 30 is a circuit diagram of the control signal generating circuit 400 shown in FIG. 29, and FIG. 31 illustrates a time chart of the operation of the control signal generating circuit 400 shown in FIG. 30. Clock (CL1) is inputted to the control signal generating circuit 400, and as shown in FIG. 31, the clock (CL1) is divided in two by a D type flip flop circuit (F1) to thereby, constitute clock (HCL1). The clock (HCL1) is divided in two by a D type flip flop circuit (F2) to thereby constitute clock (QCL1), which represents the clock (CL1) divided in four. Further, the control signal generating circuit 400 is inputted with a frame recognizing signal (FLMN) for recognizing a respective frame. A description will be given later of a method of generating the frame recognizing signal (FLMN). The frame recognizing signal (FLMN) is inverted by an inverter (INV) to thereby constitute a signal (FLMIP).

As shown by FIG. 31, the signal (FLMIP) is divided in two by a D type flip flop circuit (F3) to thereby constitute a signal (HCL1). The signal (HCL1) is divided in two by a D type flip flop circuit (F4) to thereby constitute a signal (QFLM), which represents the frame recognizing signal (FLMN) divided in four. Further, the clock (QCL1) and the signal (QFLM) are inputted to an exclusive OR circuit (EXOR1), a signal (CHOPA) is outputted from the exclusive OR circuit (EXOR1) and a signal (CHOPB) is generated by inverting the signal (CHOPA) using an inverter (INV). The signals (CHOPA, CHOPB) are subjected to level shift by a level shift circuit to thereby constitute the control signal (A) and the control signal (B). Thereby, the phases of the control signal (A) and the control signal (B) can be inverted every 2 lines in each frame and every 2 frames.

When the phases of the control signal (A) and the control signal (B) are inverted every 2 frames, the signal (QFLM) constituted by dividing the frame recognizing signal (FLMN) in four may constitute the signal (CHOPA), and the signal (CHOPB) may be constituted by inverting the signal (CHOPA) using the inverter (INV). In this case, according to the control signal generating circuit 400 shown in FIG. 30, the D type flip flop circuits (F1, F2) and the exclusive OR circuit (EXORL) are not needed. Further, according to the control signal generating circuit 400, the D type flip flop circuits (F1, F2) are initialized by the frame recognizing signal (FLMN). Meanwhile, the D type flip flop circuits (F3, F4) are initialized by a signal (PORN) from a PORN signal generating circuit 401. The PORN signal generating circuit 401 is constituted by a voltage dividing circuit 402 for dividing power source voltage (VDD) at high voltage and an inverter circuit group 403 inputted with output from the voltage dividing circuit 402.

The power source voltage (VDD) is generated by a DC/DC converter (not illustrated) in the power source circuit 120 shown in FIG. 1, and the power source voltage (VDD) rises after a while from a time point at which the power is inputted to the liquid crystal display device. Therefore, after inputting the power of the liquid crystal display device, the signal (PORN) of the PORN signal generating circuit 401 stays at the L level for a while, and, accordingly, the D type flip flop circuits (F3, F4) are initialized with certainty when the power is inputted to the liquid crystal display device.

(Method of generating frame recognizing signal according to the embodiment)

Next, an explanation will be given of a method of generating the frame recognizing signal (FLMN) according to the embodiment.

In generating the frame recognizing signal (FLMN), there is needed a signal for recognizing switching of a frame. Further, a frame start instruction signal is outputted from the display control device 110 to the gate driver 140, and, accordingly, when the frame start instruction signal is inputted also to the drain driver 130, the frame recognizing signal (FLMN) can easily be generated.

However, according to this method, the number of input pins of a semiconductor integrated circuit (semiconductor chip) constituting the drain driver 130 needs to increase, thereby, the wiring pattern of the printed wiring board needs to be changed. Further, with a change in the wiring pattern of the printed wiring board, a high frequency noise characteristic generated by the liquid crystal display device is changed, resulting in a concern of deterioration in the EMI (electromagnetic interference) level. Further, the compatibility of the input pins is lost when the number of input pins of the semiconductor integrated circuit is increased.

Therefore, according to the embodiment, at respective features, the pulse widths of the start pulses outputted from the display control device 110 to the drain driver 130 are made to differ by an initial start pulse (hereinafter, referred to as start pulse for frame) and other start pulses (hereinafter, referred to as start pulses in frame) for respective frames, thereby, switching of a respective frame is recognized and the frame recognizing signal (FLMN) is generated.

Figure 32:
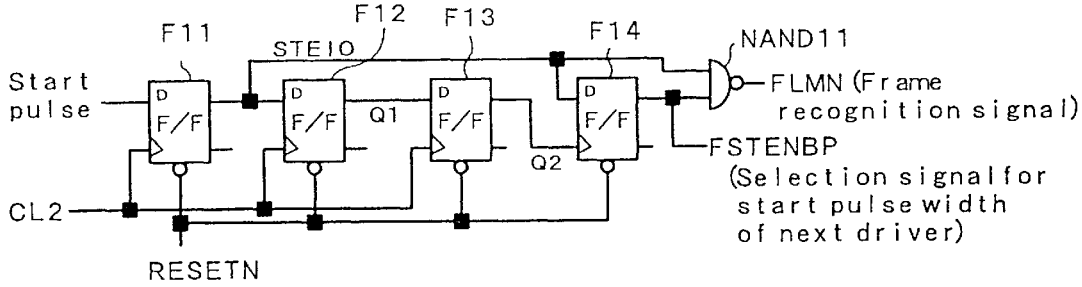
FIG. 32 is a circuit diagram showing a circuit constitution of a frame recognizing signal generating circuit shown in FIG. 29.
Figure 33A:
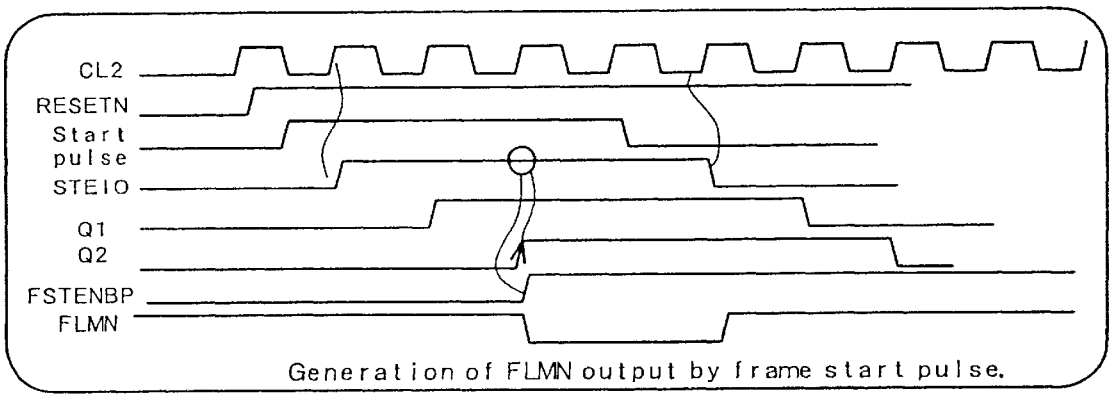
FIGS. 33(*a*) and 33(*b*) are timing charts illustrating the operation of the frame recognizing signal generating circuit shown in FIG. 32.
Figure 33B:
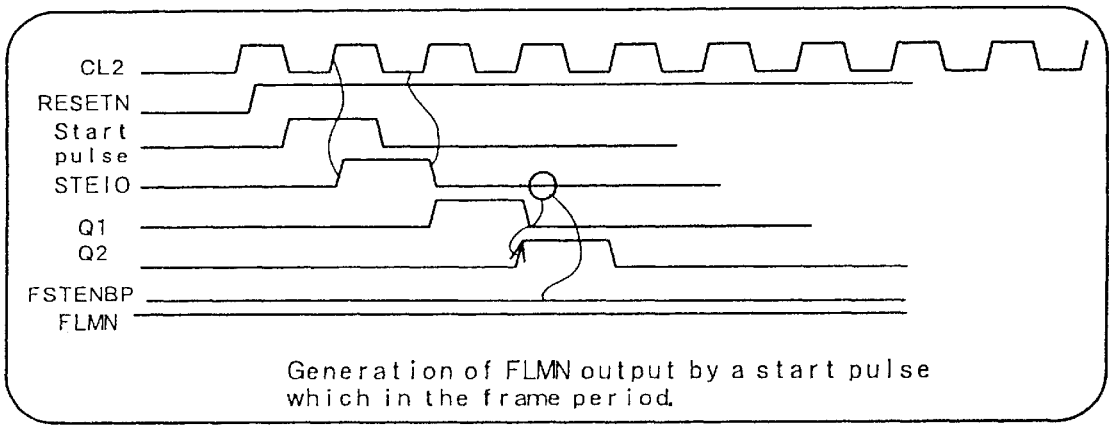

FIG. 32 is a circuit diagram showing of the frame recognizing signal generating circuit 410 shown in FIG. 29, and FIGS. 33(*a*) an 33(*b*) illustrate time charts of the operation of the frame recognizing signal generating circuit 410. According to the embodiment, the start pulse for a frame is provided with a pulse width of four periods of the clock signal (CL2), and the start pulse in a frame is provided with a pulse width of one period of the clock signal (CL2).

In FIG. 32, D type flip flop circuits (F11 through F13) are inputted with clock (CL2) at clock signal input terminals thereof Therefore, the start pulse is latched by the D type flip flop circuit (F11) in synchronism with the clock (CL2) to thereby constitute a signal (STEIO). The signal (STEIO) is latched by the D type flip flop circuit (F12) in synchronism with the clock (CL2) to thereby constitute a signal (Q1), and the signal (Q1) is latched by the D type flip flop circuit (F13) in synchronism with the clock (CL2) to thereby constitute a signal (Q2).

The signal (Q2) is inputted to the clock signal input terminal of the D type flip flop circuit (F14), and the data input terminal (D) of the D type flip flop circuit (F14) receives the signal (STEIO).

Therefore, when the start pulse is a start pulse for a frame having a pulse width of four periods of the clock signal (CL2), Q output of the D type flip flop circuit (F14) becomes H level. Here, the Q output of the D type flip flop circuit (F14) constitutes a start pulse selecting signal (FSTENBP) for a successive drain driver, and, accordingly, the start pulse selecting signal (FSTENBP) becomes H level. Further, the Q output from the D type flip flop circuit (F14) and the signal (STEIO) are inputted to an NAND circuit (NAND11), the output of the NAND circuit (NAND11) becomes the frame recognizing signal (FLMN), and, accordingly, the frame recognizing signal (FLMN) becomes L level by two periods of the clock (CL2).

Meanwhile, when the start pulse is the start pulse in a frame having a pulse width of one period of the clock signal (CL2), the Q output of the D type flip flop circuit (F14) becomes L level. Thereby, the start pulse selecting signal (FSTENBP) becomes L level and the frame recognizing signal (FLMN) maintains the H level. Further, the respective D type flip flop circuits (F11 through F14) are initialized by a signal (RESETN). According to the embodiment, an inverted signal of clock (CL1) is used as the signal (RESETN).

Further, according to the embodiment, while an explanation has been given of the case in which the start pulse for a frame is provided with a pulse width of four periods of the clock signal (CL2), the invention is not limited thereto, but the pulse width of the start pulse for a frame can arbitrarily set so long as the frame recognizing signal (FLMN) which becomes L level at a predetermined time period can be generated only when the start pulse for a frame is inputted.

According to the embodiment, the first one of the drain driver 130 is supplied with the start pulse for a frame and the start pulse in the frame from the display control device 110, and the above-described operation is executed. However, according to the drain drivers 130 at the second one and thereafter, the start pulse for a frame and the start pulse in the frame are not inputted from the display control device 110, and, accordingly, in order to execute the above-described operation also in the drain drivers 130 at the second one and thereafter, it is necessary to constitute the start pulse by a pulse having a pulse width which is the same as that of the inputted start pulse and outputting the start pulse to a successive one of the drain drivers 130. Therefore, according to the embodiment, the start pulse for a frame having a pulse width of four periods of the clock signal (CL2) is generated by the pulse generating circuit 440 shown in FIG. 29, and when inputted start pulse is the start pulse for the frame, the start pulse for the frame generated by the pulse generating circuit 440 is transmitted to a successive one of the drain drivers 130.

(Method of generating a start pulse for a frame according to the embodiment)

An explanation will be given of a method of generating a start pulse for a frame and a start pulse in the frame in the drain driver 130.

Figure 34:
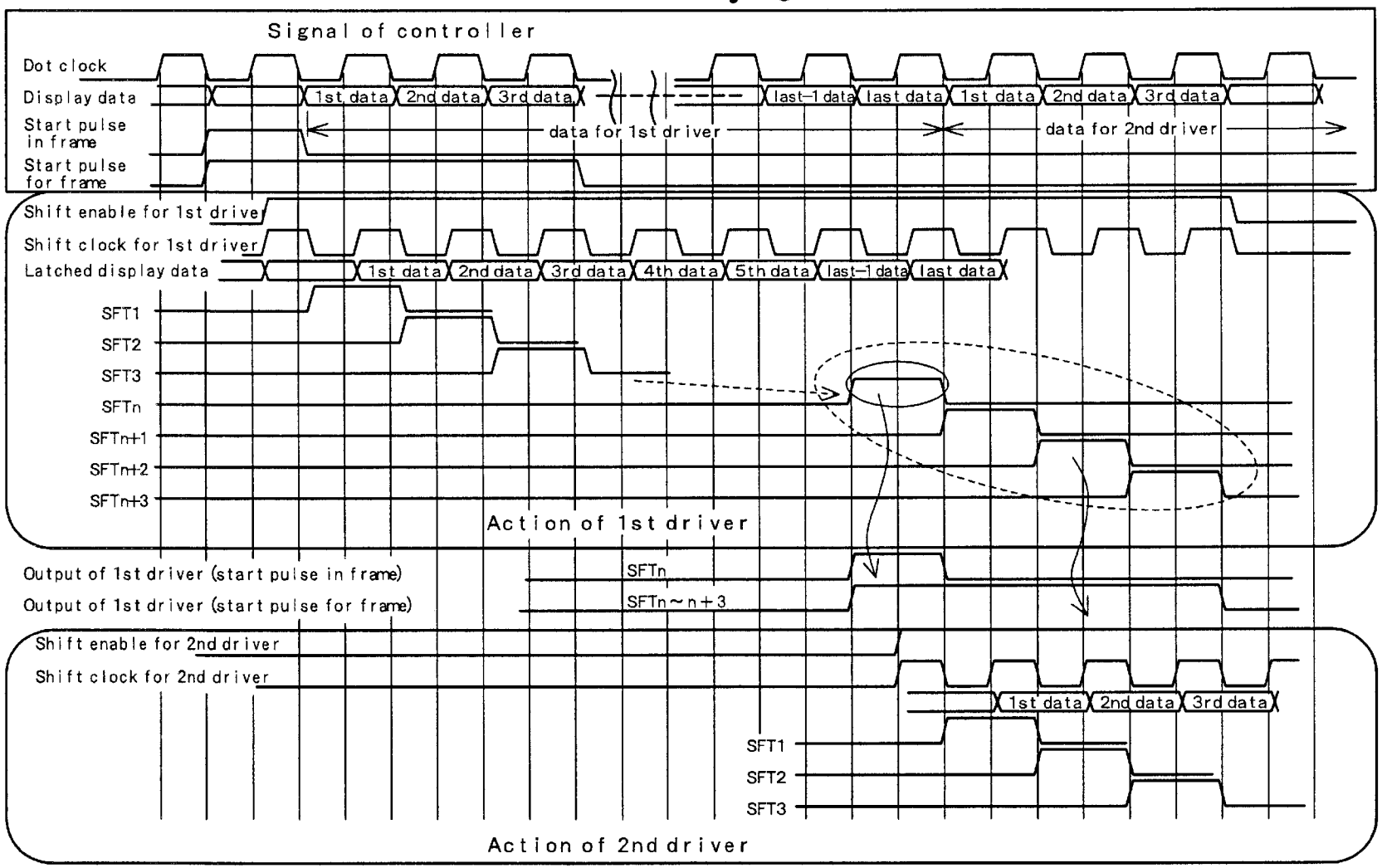
FIG. 34 is a timing chart illustrating the operation of a control circuit according to Embodiment 1.

FIG. 34 illustrates a time chart for explaining operation of the control logic unit 152 in the drain driver 130 according to the embodiment shown in FIG. 29. As shown in FIG. 34, when the shift clock enable signal generating circuit 420 is supplied with a start pulse, the shift clock enable signal generating circuit 420 outputs an enable signal (EENB) at H the level to the shift clock generating circuit 430. Thereby, the shift clock generating circuit 430 generates a shift clock in synchronism with the clock (CL2) and outputs the shift clock to the shift register circuit 153.

Respective flip flop circuits of the shift register circuit 153 successively output data input signals (SFT1 through SFTn+3), and, thereby, display data is latched in the input register 154. Further, the data input signal of SFTn constitutes start pulse in the frame of the drain driver 130 at a successive stage having a pulse width of one period of the clock (CL2). In this case, although data input signals of SFT1 through SFTn are used for latching a first one through an n-th one of display data to the input register 154, data input signals of SFTn+1 through SFTn+3 are not used for latching display data to the input register 154.

The data input signals of the SFTn+1 through SFTn+3 are used for generating a start pulse for the frame at a successive stage of the drain driver 130. That is, as shown in FIG. 34, at the clock generating circuit 450, based on the data input signals SFTn through SFTn+3, a start pulse for the frame having a pulse width of four periods of the clock (CL2) is generated. As described above, when the start pulse is a start pulse in the frame, the start pulse selecting signal (SFTENBP) becomes L level, and, accordingly, the pulse selecting circuit 450 selects a start pulse in the frame (that is, data input signal of SFTn) and outputs the start pulse in the frame to a successive one of the drain drivers 130. Meanwhile, when the start pulse is a start pulse for the frame, the start pulse selecting signal (FSTENBP) becomes H level, and, accordingly, the pulse selecting circuit 450 selects the start pulse for the frame and outputs the start pulse for the frame to a successive one of the drain drivers 130. In this case, as the clock generating circuit 450, for example, there can be used one shown in FIG. 35.

Figure 35:
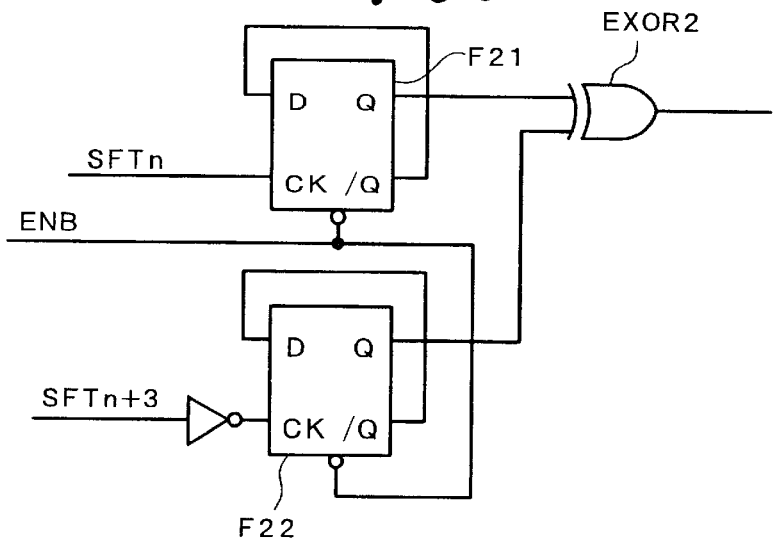
FIG. 35 is a circuit diagram showing an example of a clock generating circuit shown in FIG. 29.

According to the clock generating circuit 450 shown in FIG. 35, based on the data input signal of SFTn, Q output of the D type flip flop circuit (F21) is inverted, and, based on the data input signal of SFTn+3 inverted by the inverter (INV), the Q output of the D type flip flop circuit (F22) is inverted. Further, the Q outputs of the D type flip flop circuit (F21) and the D type flip flop circuit (F22) are inputted to an exclusive OR circuit (EXOR2), and the start pulse for the frame having the pulse width of four periods of the clock (CL2) is generated from the exclusive OR circuit (EXOR2).

In this wary, according to the embodiment, in the respective drain drivers 130, the start pulse for a frame and the start pulse in the frame are generated, and, accordingly, thereby, a switching of a respective frame can be recognized in the respective drain driver 130 without increasing the number of input pins of the semiconductor integrated circuit constituting the drain driver 130 while maintaining the compatibility of the input pins.

(Modified example of amplifier according to the embodiment)

In the case of the low voltage amplifier 272 shown in FIG. 21, in view of the voltage characteristic thereof, it is difficult to make the output voltage equal to the voltage of the power source 1. Similarly, in the case of the high voltage amplifier 271 shown in FIG. 22, it is difficult to make voltage of the output terminal equal to voltage of the power source 2. Therefore, when the voltage of the power source 1 or the voltage of the power source 2 is one of the sixty-four grayscale levels of grayscale voltages, it is difficult to output the grayscale voltage to the drain signal line (D).

Figure 36:
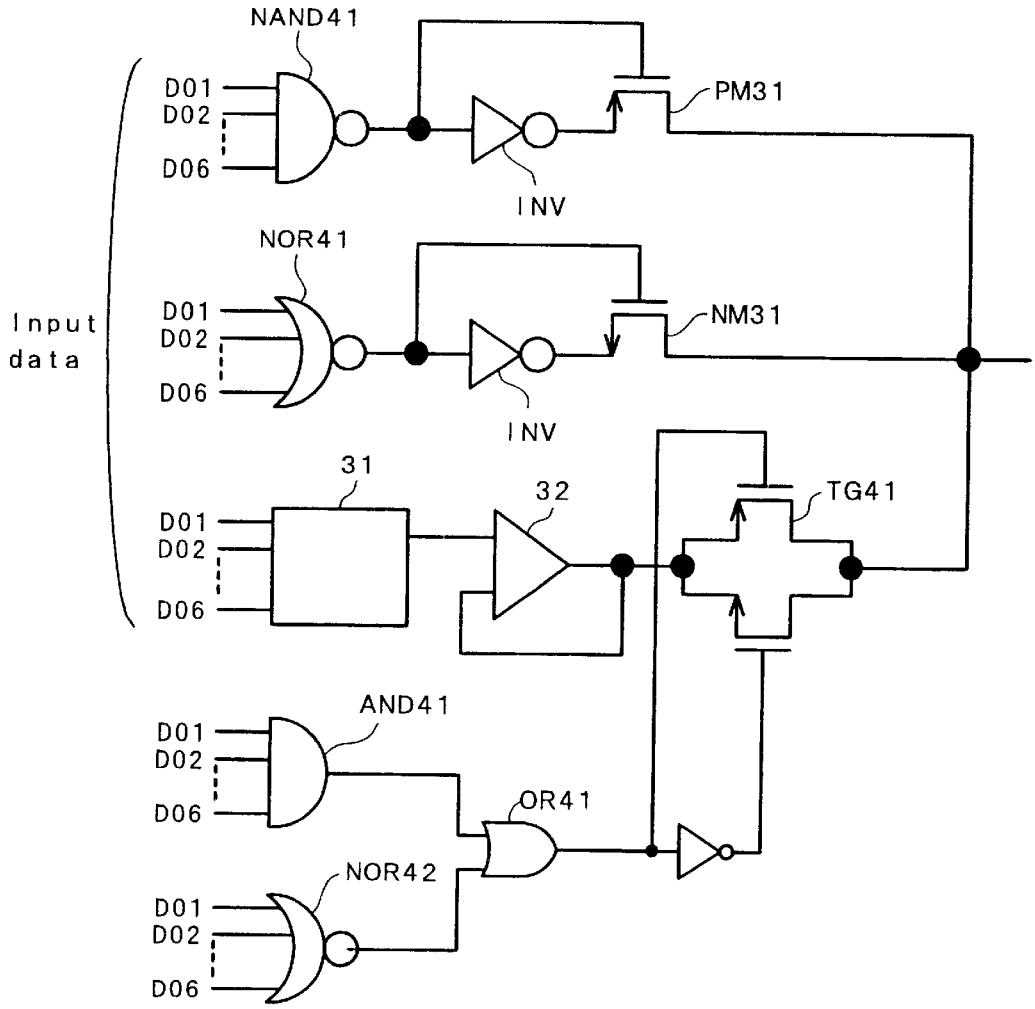
FIG. 36 is a circuit diagram showing a modified example of an amplifier according to an embodiment of the invention.

FIG. 36 is a circuit diagram showing a modified example of an amplifier according to the present invention. In FIG. 36, only one output route is illustrated, and, the precharge circuit 30 shown in FIG. 7 and the switch unit (2) 264 shown in FIG. 6 are omitted. That is, in FIG. 36, the decoder circuit 31 represents the high voltage decoder 278 or the low voltage decoder 279 shown in FIG. 6, and the amplifier 32 represents the high voltage amplifier 271 or the low voltage amplifier 272 shown in FIG. 6.

Generally, a grayscale voltage equal to the voltage of the power source 1 or the voltage of the power source 2 corresponds to a case in which all of the bit values of the display data are "0" or "1". Hence, with the amplifier shown in FIG. 36, the state in which all of the bit values of the display data are "1" is detected by an NAND circuit (NAND41), in response to which the voltage of the power source 2 is outputted to the drain signal line (D). That is, in the case in which all of the bit values of the display data are "1", the output of the NAND circuit (NAND41) becomes L level, and the L level is inverted by an inverter (INV31) to become H level, which is applied to a source electrode of the PMOS transistor (PM31) to thereby turn the PMOS transistor (PM31) ON and supply the voltage of the power source 2 to the drain signal line (D). Similarly, in the case in which all of the bit values of the display data are "0", an output of an NOR circuit (NOR41) becomes H level, and the H level is inverted by an inverter (INV32) to become L level, which is applied to a source electrode of an NMOS transistor (NM31) to thereby turn the NMOS transistor (NM31) ON and supply the voltage of the power source 1 to the drain signal line (D).

The power source voltages of the inverters (INV31, INV32) are naturally the voltage of the power source 1 and the voltage of the power source 2. Further, by changing the power source voltages of the inverters (INV31, INV32), in the case in which all of the bit values of the display data are "0" and "1", the drive voltage supplied to the drain signal line (D) can also be changed.

The case in which all of the bit values of the display data are "1" is detected by an AND circuit (AND41), while the case in which all of the bit values of the display data are "0" is detected by a NOR circuit (NOR42), and outputs of the AND circuit (AND41) and the NOR circuit (NOR42) are inputted to the transfer gate (TG41) via an OR circuit (OR41) to thereby separate the amplifier 32 from the drain signal line (D). In this way, according to the amplifier shown in FIG. 36, the highest grayscale voltage in sixty-four grayscale levels of grayscale voltages in the case in which, for example, all of the bit values of the display data are "1" and the lowest grayscale voltage in the case in which, for example, all of the bit values of the display data are "0", are power source voltages, whereby the grayscale voltages can be outputted to the drain signal line (D) with certainty.

With to the amplifier shown in FIG. 36, in the case in which all of the bit values of the display data are "1", and in the case in which all of the bit values of the display data are "0", the transfer gate (TG41) is turned OFF; and, accordingly, by stopping operation of the amplifier 32 during the time period, the power consumption can be reduced. This can be carried out by a circuit such as shown in FIG. 37, in the case in which the amplifier 32 is an amplifier having a circuit constitution as shown in FIG. 18.

Figure 37:
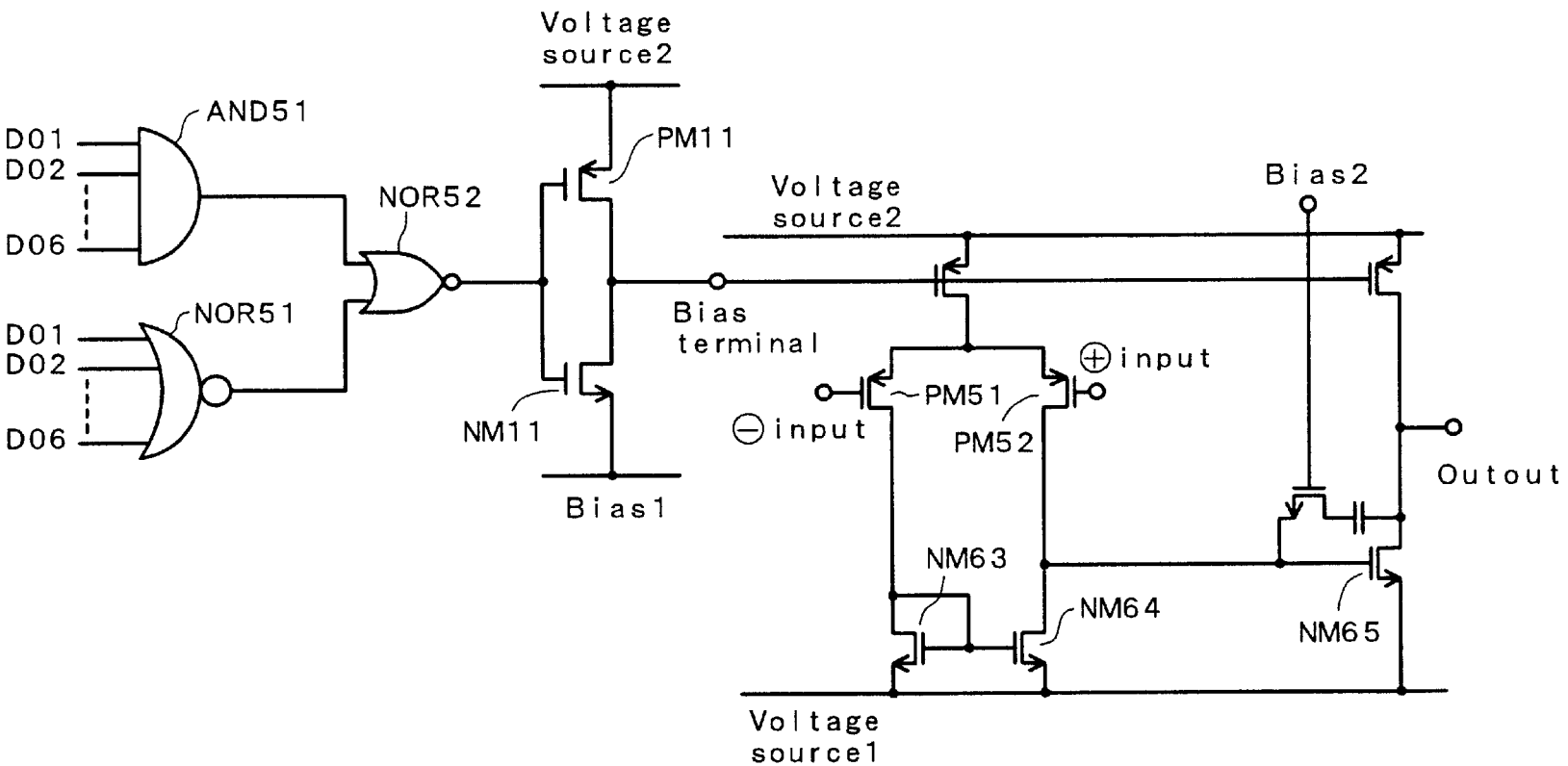
FIG. 37 is a circuit diagram showing a modified example of an amplifier according to an embodiment of the invention.

With to the circuit shown in FIG. 37, the case in which all of the bit values of the display data is "1" is detected by an AND circuit (AND51) and the case in which all of the bit value of the display data is "0" is detected by an NOR circuit (NOR51), and outputs of the AND circuit (AND51) and the NOR circuit (NOR51) are applied to a gate electrode of a PMOS transistor (PM11) and a gate electrode of an NMOS transistor (NM11) via an NOR circuit (NOR52). Therefore, with the circuit shown in FIG. 37, in the case in which all of the bit values of the display data are "1" and the case in which all of the bit values of the display data are "0", the NOR circuit (NOR52) becomes "0"; and, accordingly, in this case, the PMOS transistor (PM11) is turned ON, the power source 2 is applied to a bias terminal of the amplifier 32, and, therefore, operation of the amplifier 32 is stopped. In cases other than the case in which all of the bit values of the display data are "1" and the case in which all of the bit values of the display data are "0", the NOR circuit (NOR52) becomes "1"; and, accordingly, in this case, the NMOS transistor (NM11) is turned ON and bias 1 is applied to the bias terminal of the amplifier 32, with the result that the amplifier 32 executes a normal operation.

Although the above-described explanation has been given of embodiments in which the invention is applied to a liquid crystal display panel of the vertical electric field type, the invention is not limited thereto, but is applicable to a liquid crystal display panel of the horizontal electric field type as well.

Figure 38:
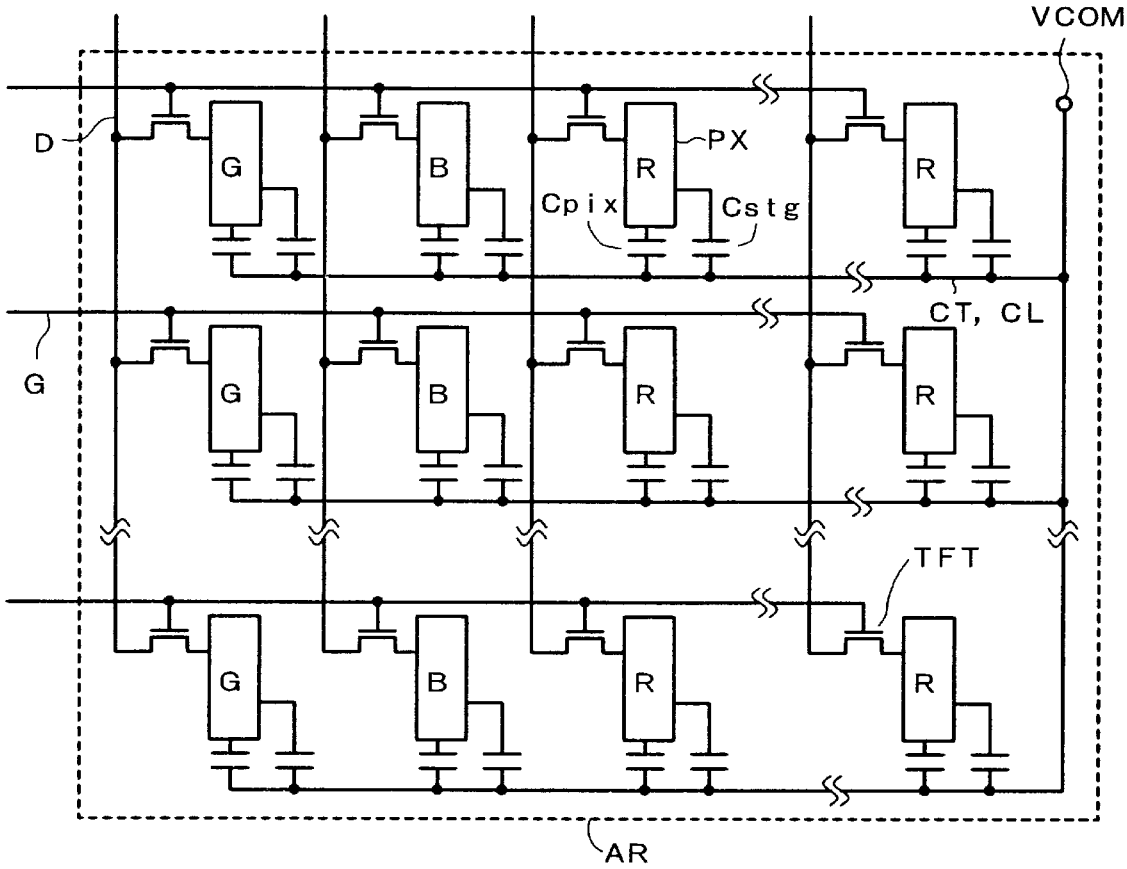
FIG. 38 is an equivalent circuit diagram of a liquid crystal display panel of a horizontal electric field system.

FIG. 38 shows an equivalent circuit of a liquid crystal display panel of the horizontal electric field type. In contrast to the liquid crystal display panel of the vertical electric field type, as shown in FIG. 2 or FIG. 3, the common electrode (IT02) is provided in a color filter board, according to the liquid crystal display panel of the horizontal electric field type, and there are provided opposed electrodes (CT) and opposed electrode signal lines (CL) for applying drive voltage (VCOM) to the opposed electrodes (CT). Therefore, a liquid crystal capacitance (Cpix) is equivalently connected between a pixel electrode (PX) and the opposed electrode (CT). Further, a storage capacitor (Cstg) is also formed between the pixel electrode (PX) and the opposed electrode (CT).

Although an explanation has been given of embodiments in which the dot inversion system is applied as the drive method, the invention is not limited thereto, but the invention is applicable to a common inversion method in which the drive voltage applied to the pixel electrode (IOT1) in the common electrode (IT02) is inverted at every line or every frame.

As described above, a specific explanation has been given of the present invention based on various embodiments of the invention, however, the invention is not limited to the disclosed embodiments of the invention, but can naturally be modified variously within a scope not deviated from the gist of the invention.

A summary of the effects achieved by representative aspects of the invention disclosed in this application is as follows.

(1) According to the invention, the output delay time period (tDD) of the semiconductor integrated circuit device constituting the image signal line driving means can be reduced, and, accordingly, the display quality of display data displayed on a liquid crystal display clement can further be promoted.

(2) According to the invention, the output delay time period (tDD) of the semiconductor integrated circuit device constituting the image signal line driving means can be reduced, and, accordingly, high speed operation and large screen formation of the liquid crystal display element can be achieved.

(3) According to the invention, it is possible to prevent a black or white vertical streak from being generated in the display screen of the liquid crystal display clement owing to the offset voltage of the amplifier in the semiconductor integrated circuit device constituting the image signal line driving means, to thereby promote the surface quality of the display screen displayed in the liquid crystal display element.

What is claimed is:

1. A liquid crystal display device comprising:

a liquid crystal display element having a plurality of pixels and a plurality of image signal lines for applying grayscale voltages in correspondence with display data to the plurality of pixels; and image signal line driving means constituted by at least a single semiconductor integrated circuit device for supplying the grayscale voltages in correspondence with the display data to the respective image signal lines;

wherein the semiconductor integrated circuit device comprises:

a plurality of grayscale voltage selecting means for selecting the grayscale voltages in correspondence with the display data inputted from the plurality of grayscale voltages and constituted by a transistor having a minimum size in the semiconductor integrated circuit device;

a plurality of amplifiers for amplifying the grayscale voltages selected by the respective grayscale voltage selecting means and outputting the selected grayscale voltages to the respective image signal lines;

first switching means provided between the respective grayscale voltage selecting means and the amplifiers;

second switching means provided between a power source line supplied with a predetermined charge voltage and the respective amplifiers; and switching controlling means for switching off the first switching means and switching on the second switching means in an initial predetermined time period of one horizontal scanning time period;

wherein the switching controlling means switches off the first switching means before switching on the second switching means and switches on the first switching means after switching off the second switching means.

2. The liquid crystal display device according to claim 1:

wherein the switching controlling means controls the first and the second switching means based on a clock for controlling an output timing and a clock for latching the display data.

3. The liquid crystal display device according to claim 1:

wherein the predetermined charge voltage is any voltage in the plurality of grayscale voltages.

4. The liquid crystal display device according to claim 1:

wherein the semiconductor integrated circuit device includes grayscale voltage generating means for generating the plurality of grayscale voltages based on a plurality of grayscale reference voltages supplied from outside and for supplying the plurality of grayscale voltages to the respective grayscale voltage selecting means; and wherein the predetermined precharge voltage is any voltage in the plurality of grayscale reference voltages supplied from outside.

5. The liquid crystal display device according to claim 1:

wherein when in the plurality of grayscale voltages supplied to one side of a liquid crystal layer of each of the plurality of pixels, the grayscale voltage having the largest potential difference relative to an opposed voltage applied to other side of the liquid crystal layer of each of the plurality of pixels constitutes a maximum grayscale voltage and the grayscale voltage having the smallest potential difference relative to the opposed voltage constitutes the smallest grayscale voltage, the predetermined charge voltage is voltage deviated to the maximum grayscale voltage in comparison with intermediate voltage between the maximum grayscale voltage and the minimum grayscale voltage.

6. The liquid crystal display device according to claim 5:

wherein the respective amplifiers comprise voltage follower circuits.

7. The liquid crystal display device according to claim 1:

wherein the plurality of amplifiers comprise a plurality of amplifier couples each constituted by first amplifier couples of which the output grayscale voltages have a positive polarity and second amplifier couples of which the output grayscale voltages have a negative polarity;

wherein the grayscale voltage selecting means connected to the first amplifiers of the respective amplifier couples select grayscale voltages in correspondence with display data inputted from the plurality of grayscale voltages having the positive polarity;

wherein the grayscale voltage selecting means connected to the second amplifiers of the respective amplifier couples select grayscale voltages in correspondence with the display data inputted from the plurality of grayscale voltages having the negative polarity, further comprising:

display data switching means for switching alternately arbitrary couples of display data inputted to the grayscale voltage selecting means connected to the first amplifiers of the respective amplifier couples and the grayscale voltage selecting means connected to the second amplifiers of the respective amplifier couples; and image signal line switching means for switching alternately the couples of grayscale voltages outputted from the respective amplifier couples in accordance with switching of the display data switching means and outputting the couples of grayscale voltages to arbitrary couples of the image signal lines.

8. The liquid crystal display device according to claim 7:

wherein the first amplifier includes:

current flowing means for causing current to flow from the image signal line connected to the first amplifier when voltage of the image signal line connected to the first amplifier is higher than the grayscale voltage having the positive polarity inputted to the first amplifier.

9. The liquid crystal display device according to claim 7:

wherein the second amplifier includes:

current supplying means for supplying a current to the image signal line connected to the second amplifier when a voltage of the image signal line connected to the second amplifier is lower than the grayscale voltage having the negative polarity inputted to the second amplifier.

10. The liquid crystal display device according to claim 1, further comprising:

specific grayscale voltage generating means for outputting a grayscale voltage in correspondence with display data and supplying the grayscale voltage to image signal lines connected to respective amplifiers when all of the respective bit values of the display data are "1" or "0"; and third switching means provided between the respective amplifiers and the respective image signal lines for separating the respective amplifiers from the respective image signal lines when all of the respective bit values of the display data are "1" or "0".

11. The liquid crystal display device according to claim 10:

wherein the specific grayscale voltage generating means comprises:

a logical circuit having a power source voltage of the grayscale voltage when all of the respective bit values of the display data are "1" or "0" for outputting an H level or an L level signal when all of the respective bit values of the display data are "1" or "0".

12. A liquid crystal display device comprising:

a liquid crystal display element having a plurality of pixels and a plurality of image signal lines for applying grayscale voltages in correspondence with display data to the plurality of pixels; and image signal line driving means constituted by at least a single semiconductor integrated circuit device for supplying the grayscale voltages in correspondence with the display data to the respective image signal lines;

wherein the semiconductor integrated circuit device comprises:

a plurality of grayscale voltage selecting means for selecting the grayscale voltages in correspondence with the display data inputted from the plurality of grayscale voltages and constituted by a transistor having a minimum size in the semiconductor integrated circuit device;

a plurality of amplifiers for amplifying the grayscale voltages selected by the respective grayscale voltage selecting means and outputting the selected grayscale voltages to the respective image signal lines, said plurality of amplifiers including switching means for switching one of a pair of two terminals of each of the amplifiers to an inverted input terminal or a noninverted input terminal and the other of the pair of two terminals to the noninverted input terminal or the inverted input terminal;

first switching means provided between the respective grayscale voltage selecting means and the respective amplifiers;

second switching means provided between a power source line supplied with a predetermined charge voltage and the respective amplifiers;

switching controlling means for switching off the first switching means and switching on the second switching means in an initial predetermined time period in one horizontal scanning time period; and switching instructing means for outputting a switch control signal for switching one of the pair of input terminals of each of the amplifiers to the noninverted input terminal and switching other thereof to the inverted input terminal to the switching means of the amplifiers at every predetermined period.

13. The liquid crystal display device according to claim 12:

wherein the respective amplifiers comprise differential amplifiers;

wherein the switching means comprises:

a first switching element for connecting a control electrode of one transistor of each of couples of transistors at an input stage to one of each of the couples of input terminals and a second switching element for connecting the control electrode of the one transistor of each of the couples of transistors at the input stage to the other of each of the couples of input terminals;

a third switching element for connecting the control electrode of the other transistor of each of the couples of transistors of the input stage to the other of each of the couples of input terminals;

a fourth switching element for connecting the control electrode of the other transistor of each of the couples of transistors at the input stage to the one of each of the couples of input terminals;

a fifth switching element for connecting a control electrode of a transistor at an output stage to a second electrode of the other transistor of each of the couples of transistors at the input stage;

a sixth switching element for connecting the control electrode of the transistor of the output stage to a second electrode of the one transistor of each of the couples of transistors of the input stage;

a seventh switching element for connecting a control electrode of each of couples of transistors constituting a functional load circuit to the second electrode of the one transistor of each of the couples of transistors of the input stage; and an eighth switching element for connecting the control electrode of each of the couples of transistors constituting the functional load circuit to the second electrode of the other transistor of each of the couples of transistors of the input stage;

wherein the first switching element, the third switching element, the fifth switching element and the seventh switching element and the second switching element, the fourth switching element, the sixth switching element and the eighth switching element are alternately turned ON or OFF by switching control signals outputted from the switch instructing means at every predetermined period.

14. The liquid crystal display device according to claim 12:

wherein the switch instructing means outputs the switch control signals at every n frames to the switching means of the respective amplifiers.

15. The liquid crystal display device according to claim 14:

wherein the semiconductor integrated circuit device includes frame switch detecting means for detecting switching of respective frames by a difference of a high level time period or a low level time period of inputted display data input start signals and outputting frame switch signals, and the switch instructing means outputs switch control signals to switching means of the respective amplifiers based on the frame switch signals from the frame switch detecting means.

16. The liquid crystal display device according to claim 15:

wherein the semiconductor integrated circuit device further includes:

display data input start signal generating means for generating and outputting display data input start signals having a different high level time period or a different low level time period based on inputted display data input start signals.

17. The liquid crystal display device according to claim 12:

wherein the switch instructing means outputs the switch control signals to the switching means of the respective amplifiers at every n lines in each of the frames and at every n of the frames.

18. The liquid crystal display device according to claim 17:

wherein the semiconductor integrated circuit device includes frame switch detecting means for detecting switching of the respective frames by a difference of a high level time period or a low level time period of inputted display data input start signals and outputting frame switch signals and switch instructing means outputs the switch control signals to the switching means of the respective amplifiers based on frame switch signals from the frame switch detecting means and a clock for controlling output timings.

19. The liquid crystal display device according to claim 12:

wherein the switch instructing means outputs switch control signals to the switching means of the respective amplifiers within the initial predetermined time period of one horizontal scanning time period.

* * * * *